US007458486B2

(12) United States Patent
Weist et al.

(10) Patent No.: US 7,458,486 B2
(45) Date of Patent: Dec. 2, 2008

(54) SELF-OPENING CLOSURE FOR COMPOSITE PACKAGINGS OR FOR CONTAINER OR BOTTLE NOZZLES FOR SEALING WITH FILM MATERIAL

(75) Inventors: Mario Weist, Stuhlingen (DE); Hansjorg Huber, Radolfzell (DE); Fritz Seelhofer, Lindau (CH)

(73) Assignee: SIG Technology Ltd., Neuhausen am Rheinfall (CH)

( * ) Notice: Subject to any disclaimer, the term of this patent is extended or adjusted under 35 U.S.C. 154(b) by 718 days.

(21) Appl. No.: 10/519,304

(22) PCT Filed: Jun. 17, 2003

(86) PCT No.: PCT/CH03/00392

§ 371 (c)(1),
(2), (4) Date: Jan. 31, 2005

(87) PCT Pub. No.: WO04/000667

PCT Pub. Date: Dec. 31, 2003

(65) Prior Publication Data

US 2006/0071000 A1 Apr. 6, 2006

(30) Foreign Application Priority Data

Jun. 20, 2002 (CH) ..... 1051/02
Aug. 21, 2002 (CH) ..... 1436/02
Mar. 24, 2003 (CH) ..... 497/03

(51) Int. Cl.
*B67D 5/00* (2006.01)

(52) U.S. Cl. ..... 222/83; 220/278

(58) Field of Classification Search ..... 222/83, 222/83.5, 80, 81, 82, 87; 220/277, 278, 265–267, 220/251–253
See application file for complete search history.

(56) References Cited

U.S. PATENT DOCUMENTS 4,483,464 A * 11/1984 Nomura ..... 222/83
5,020,690 A * 6/1991 Kishikawa et al. ..... 222/83

(Continued)

FOREIGN PATENT DOCUMENTS

EP 1088764 A1 4/2001

(Continued)

*Primary Examiner*—Lien T Ngo
(74) *Attorney, Agent, or Firm*—Edwin D. Schindler

(57) ABSTRACT

The self-opener closure consists of a pour-out spout (2) which may be sealingly assembled onto a composite packaging or onto a container spout or bottle spout to be closed with film material, of an associated rotary cap (1) as well as a self-opener sleeve (3) arranged within the pour-out spout (2) which may be set into rotation by the rotary cap (1). Force transmission means and guide means are formed on these three elements. These cooperate with one another such that on rotating the rotary cap (1) in the opening direction for the first time the self-opener sleeve (3) firstly in the pour-out spout (2) may be pushed vertically downwards and subsequently may be rotated by approximately 360° in the horizontal. Because the self-opener sleeve (3) at its lower edge and projecting from this comprises a single, combined piercing and cutting member (9) the film or the composite packaging is first reliably pierced and afterwards a disk is cut cleanly out of it and pivoted downwards.

13 Claims, 18 Drawing Sheets

Figure 1:
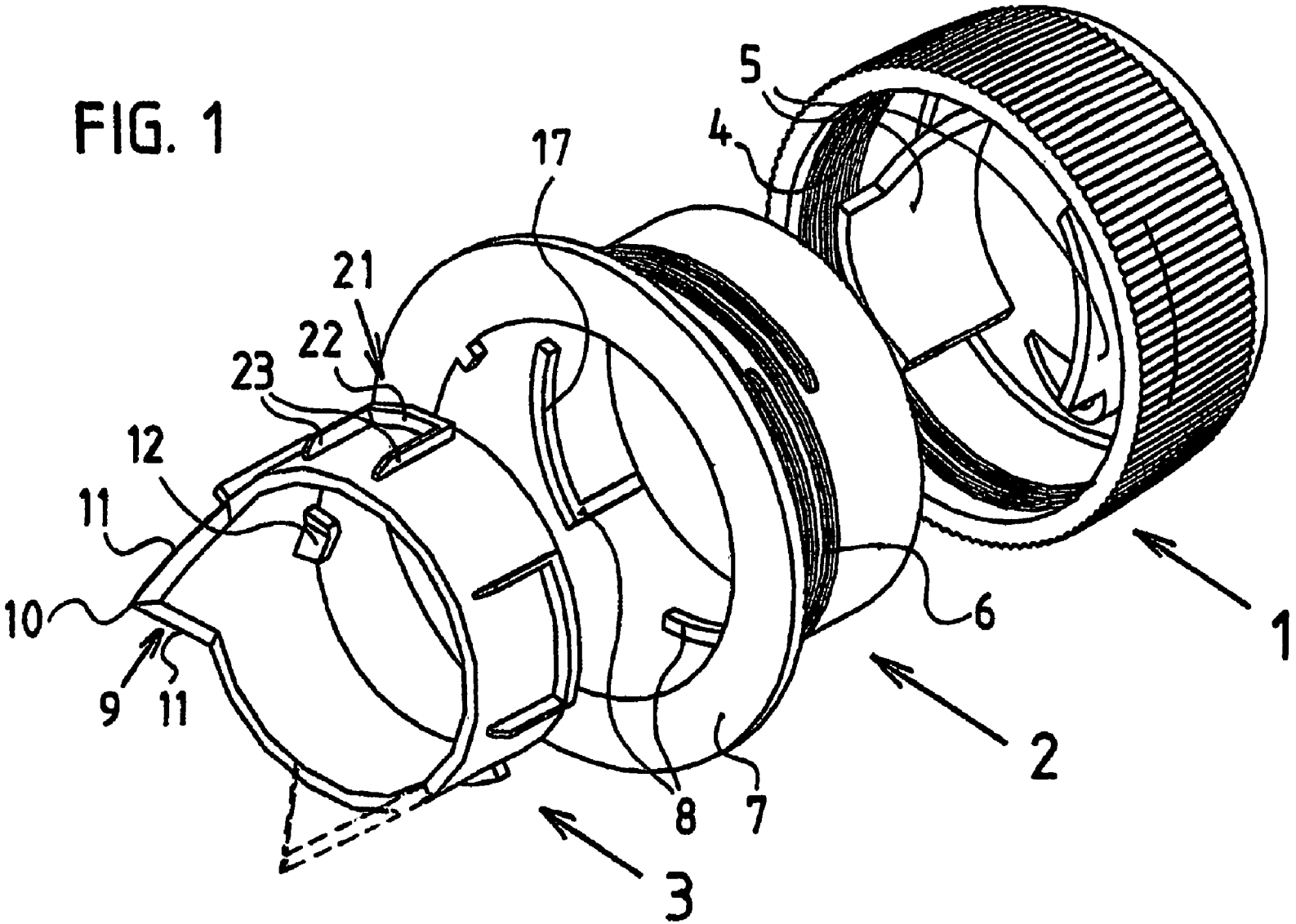

U.S. PATENT DOCUMENTS 5,482,176 A * 1/1996 Maietta et al. ..... 220/277
5,960,992 A * 10/1999 Bernstein et al. ..... 222/83.5
6,477,743 B1 * 11/2002 Gross et al. ..... 222/525
6,820,764 B2 * 11/2004 Miani et al. ..... 222/83
6,851,576 B2 * 2/2005 Dubach ..... 222/83
7,178,683 B2 * 2/2007 Birkmayer et al. ..... 215/257
7,207,465 B2 * 4/2007 Weist ..... 222/83
7,261,226 B2 * 8/2007 Adams et al. ..... 222/521

FOREIGN PATENT DOCUMENTS

WO WO 95/05996 3/1995
WO WO 02/28728 A1 4/2002

* cited by examiner

SELF-OPENING CLOSURE FOR COMPOSITE PACKAGINGS OR FOR CONTAINER OR BOTTLE NOZZLES FOR SEALING WITH FILM MATERIAL

BACKGROUND OF THE INVENTION

This invention relates to a self-opener closure for composite packaging as well as for container spouts or bottle spouts of all types to be closed with film material. At the same time one specifically envisages liquid packagings in the form of such composite packagings of film-coated paper in which milk, fruit juices, all types of non-alcoholic drinks or generally fluids also in the non-food range are packaged. The closure may however also be applied to composite packagings in which goods capable of being poured such as sugar, semolina or all types of chemicals and likewise are kept or packaged. With this film-coated paper it is the case of a laminate material such as a paper or cardboard web coated with plastic such as for example polyethylene and/or aluminium. Usually volumes of such packagings range from 20 cl up to 2 liters and more. Alternatively the self-opener closure may also be assembled on containers which are closed by a film material, such as on all types of bottles of glass or plastic or on similar containers. Such closures of plastic are known in various embodiment forms. If they are envisaged for composite packaging they essentially form a pour-out spout with a shoulder which radially projects from its lower edge and which forms a closing flange on this pour-out spout. The spout is equipped with an outer thread onto which a threaded cap may be screwed as a closure. Such a self-opener closure is flanged onto the composite packaging in that it is sealingly welded onto the composite packaging with the lower side of its projecting edge, thus with the lower side of its flange. The free passage at the lower end of the spout is thereafter closed by paper and the sealing film of the composite packaging. In the case of a bottle closure the pour-out spout for its part may be placed or screwed onto the opening of the bottle, and on its inner side is closed with a film membrane. The spout is equipped with an outer thread onto which the threaded cap may be screwed as a closure.

The film-reinforced paper passing through and below the welded-on spout, or the film membrane running within the spout must be cut open or torn open towards the opening or pressed away from this so that the passage may be released and the fluid or the pourable material may be poured or shaken out of the container through the spout. For this a sleeve is arranged within the spout which on rotating the screwed-on cap is caught by this and thus is rotated by this in the same direction of rotation. By way of a thread counter rotating to the thread on the outer side of the spout and on the outer side of the sleeve this sleeve moves continuously downwards on screwing off the threaded cap, that is to say if one displaces this upwards with respect to the liquid packaging. The lower edge of the sleeve is equipped with one or more tearing or cutting teeth. By way of this as a result of its rotation and constant downwards movement the sleeve is to press out or cut out a disk from the film-reinforced paper or the film membrane here, which runs beneath it.

Such conventional self-opener closures however do not function satisfactorily. The disks are not cut cleanly from the paper film or the film membrane, but rather the sleeve simply presses a piece of film out of this. The remaining edge is frayed and thus shreds of paper or film project into the passage which is supposed to be released open. These shreds often project downwards into the container and on pouring or shaking out possibly block the path of the outflowing jet of liquid or the shaken-out goods. With larger packagings with stronger film-reinforced paper or cardboard the opening procedure is carried out even less reliably and cleanly. The sleeve which moves slowly downwards and rotates simultaneously, with its complete lower edge quasi simultaneously contacts the film-reinforced paper web to be cut open and as a whole presses it downwards and rotates on it until a hole is scraped open or broken through rather than cleanly cut open. A cause of problem as to why the cutting-open is not effected cleanly amongst other things lies in the fact that the film to be cut open somewhat downwardly evades the pressure of the sleeve acting to a certain extent as a drill bit, and thus the sleeve no longer acts on a plane paper film but on one which is curved downwards.

The previous solutions, as a result of the design of the sleeves which usefully may be described as a penetrator because indeed they penetrate a paper film piece rather than cleanly cutting a circular disk out of it, demand a significant force on the part of the user. Specifically a large torque must be exerted since the teeth or tearers on the lower penetrator edge or sleeve edge firstly merely scratch the film firstly along the whole edge of the sleeve and then a large rotation resistance must be overcome. In the uppermost layer of the paper thickness they act similar to tear-open teeth, specifically in a scraping, pressing and tearing manner rather than acting as an actual cutting blade.

In order to simplify the breaking-out or tearing-out, for the conventional self-opener closures of this type the film material or the composite material is pre-weakened at the desired tear locations by way of lasers or punching tools. This pre-weakening however entails much technological effort. One requires very expensive installations and the handling for the machining of the penetration locations on the films is time-consuming. In spite of these complicated weakening measures the conventional self-opener closures do not cut cleanly, but tear the paper or plastic film rather than cleanly cutting it open, which explains the large resistance to rotation. On account of these large rotation resistances even breakage of the means which assume the transmission or the torque from the threaded cap to the penetrator sleeve occur, or the provided catching cams which engage into grooves on the penetrator sleeve jump out of these grooves. If this happens the self-opener closure is no longer capable of functioning. A further problem lies in the fact that the torn-out or partly cut-out film disk is folded downwards by the penetrator sleeve much too little, or the film disk over the period of use of the closure remains folded too little downwards since the penetrator sleeve is not securely fixed in its end position.

All these problems are to be solved by a proper self-opener closure. It would furthermore be desirable in one variant to have a self-opener closure which would allow the automatic metering of a small quantity of substance in solid, liquid, granular or powder form separate to the contents of the composite packaging as soon as the closure is opened, or which would effect the metering of such a separate substance in solid form when pouring out, in that the substance is poured over by the pour-out jet and washed out.

SUMMARY OF THE INVENTION

It is therefore the object to solve these problems and to provide a self-opener closure for composite packagings or for container spouts or bottle spouts to be closed with film material or already closed by film material, which for various dimensions permits a reliable cutting-out of the laminate disk or film disk in the free spout passage, wherein clean cutting edges are achieved so that one avoids shreds projecting into the passage. For a multitude of film materials and composite material one is even to do away with a targeted pre-weakening of cutting locations by punching or laser treatment. In a special embodiment the self-opener closure is also to permit an autornatic metering of a small quantity of substance in solid, liquid, granular or powder form separate to the contents of the composite packaging as soon as the packaging is opened. In another special embodiment it is also to permit the metering of a separate solid substance in that on pouring out the contents of the composite packaging this is washed out and entrained by pouring-over with a pour-out jet.

This object is achieved by a self-opener closure for composite packagings as well as container spouts or bottle spouts to be closed with film material, consisting of a pour-out spout which may be sealingly assembled onto a composite packaging or onto a container spout or bottle spout to be closed with film material, of an associated rotary cap as well as a self-opener sleeve which is arranged within the pour-out spout and which may be set into rotation by the rotary cap, and which is distinguished in that the self-opener sleeve at its lower edge and projecting from this comprises a single combined penetration and cutting member, and that this self-opener sleeve, the pour-out spout as well as the rotary cap are equipped with force transmission means which cooperate with one another in a manner such that on rotating the rotary cap in the direction of opening for the first time the self-opener sleeve firstly in the pour-out spout may be pushed axially downwards without rotation, and subsequently may be rotated about its axis without axial movement. The further objects for metering separate substances are achieved by embodiments according to the dependent patent claims.

BRIEF DESCRIPTION OF THE DRAWING FIGURES

In the figures there are shown advantageous embodiments of this self-opener closure for composite packagings in various views. By way of these figures these self-opener closures are subsequently described in detail and their function is described and explained.

There are shown in

Figure 2:
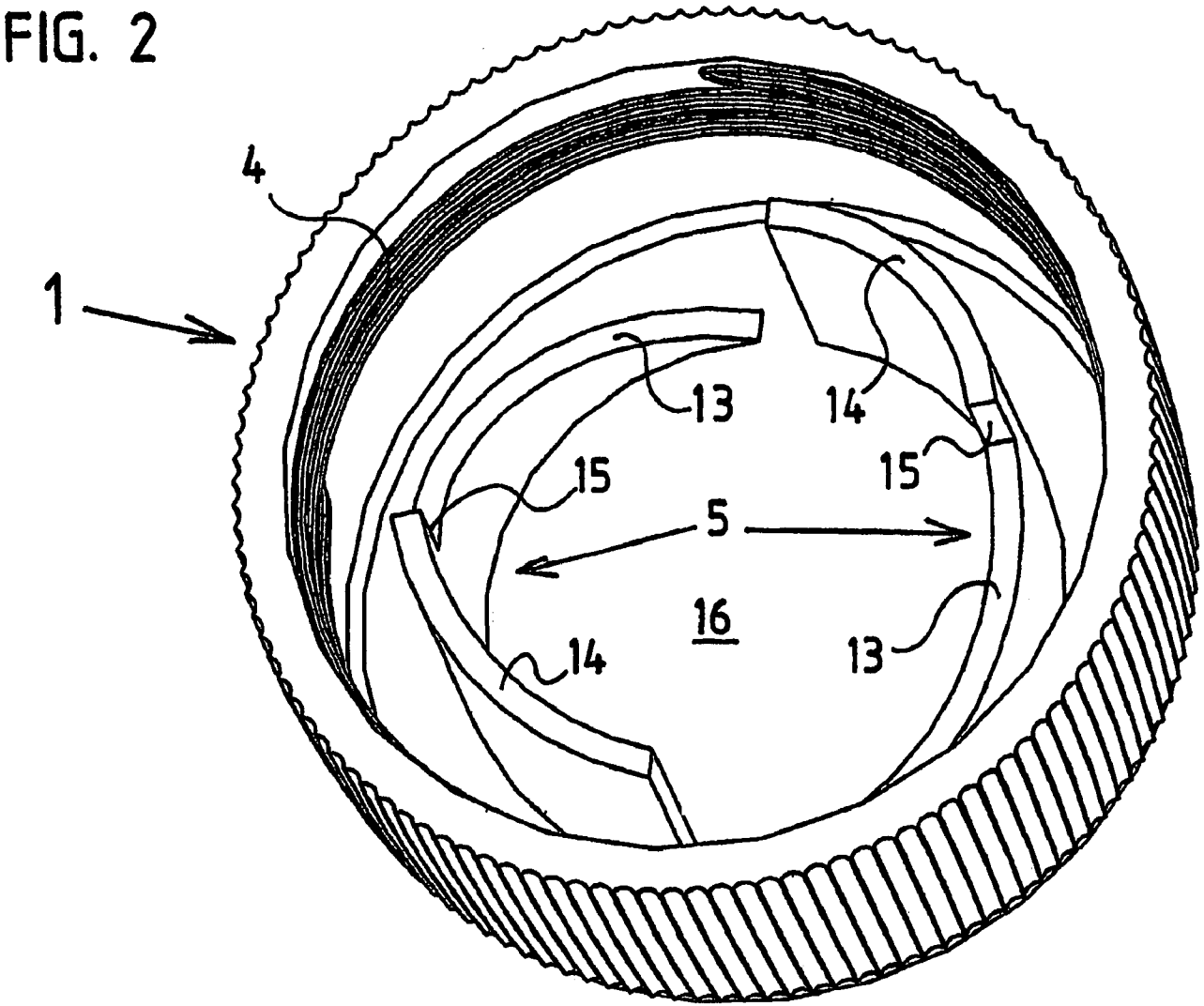
Figure 3:
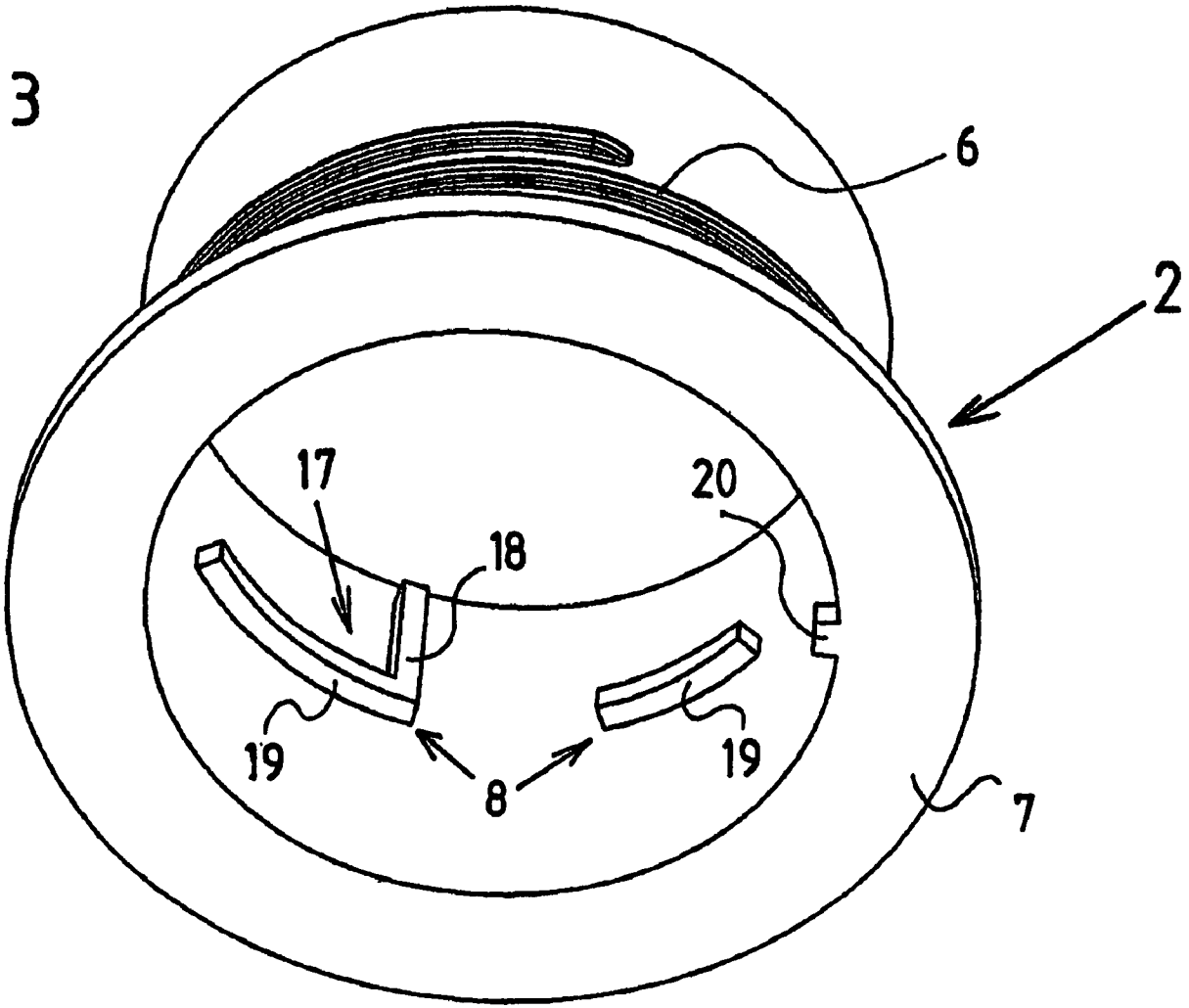
Figure 4:
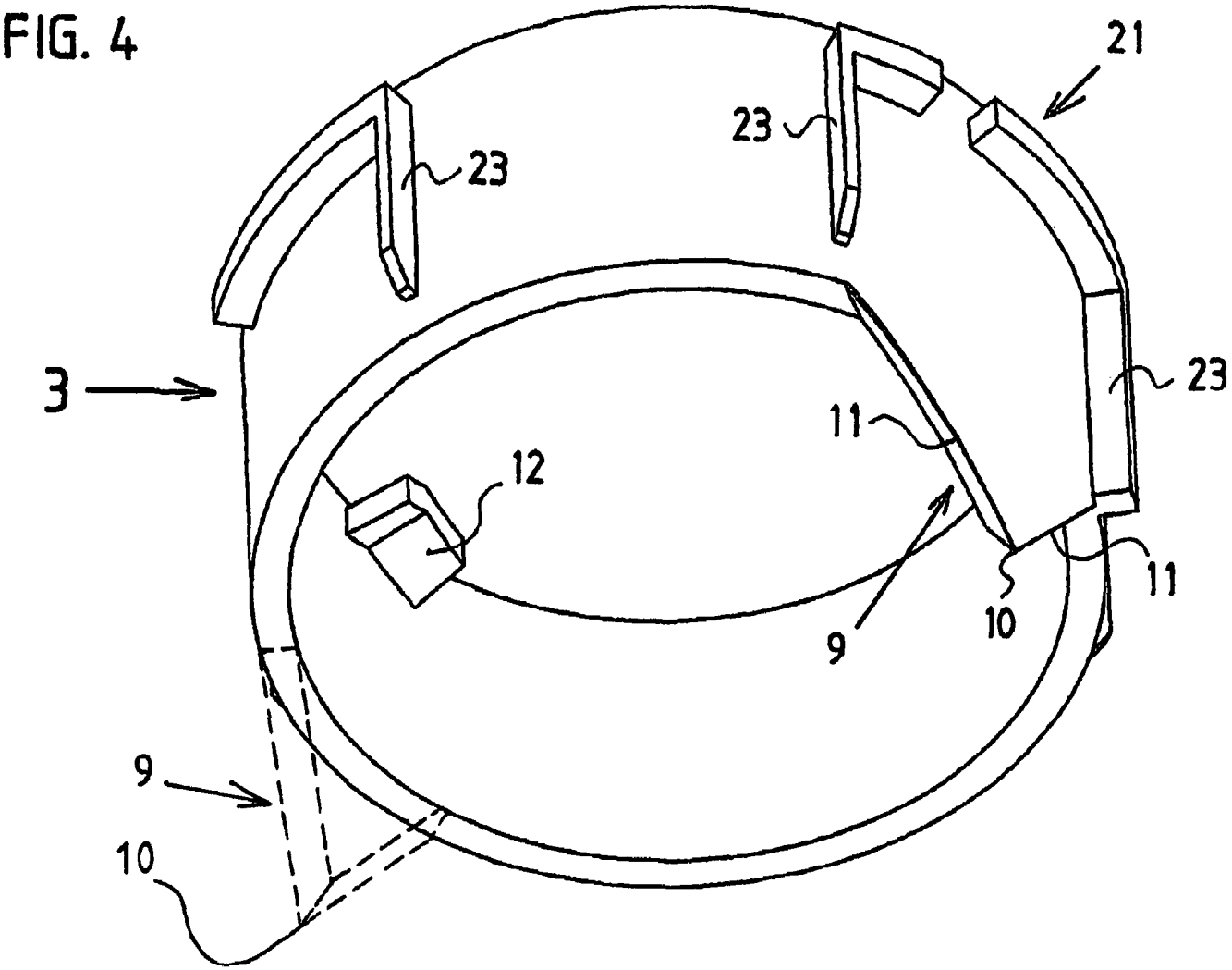
Figure 5:
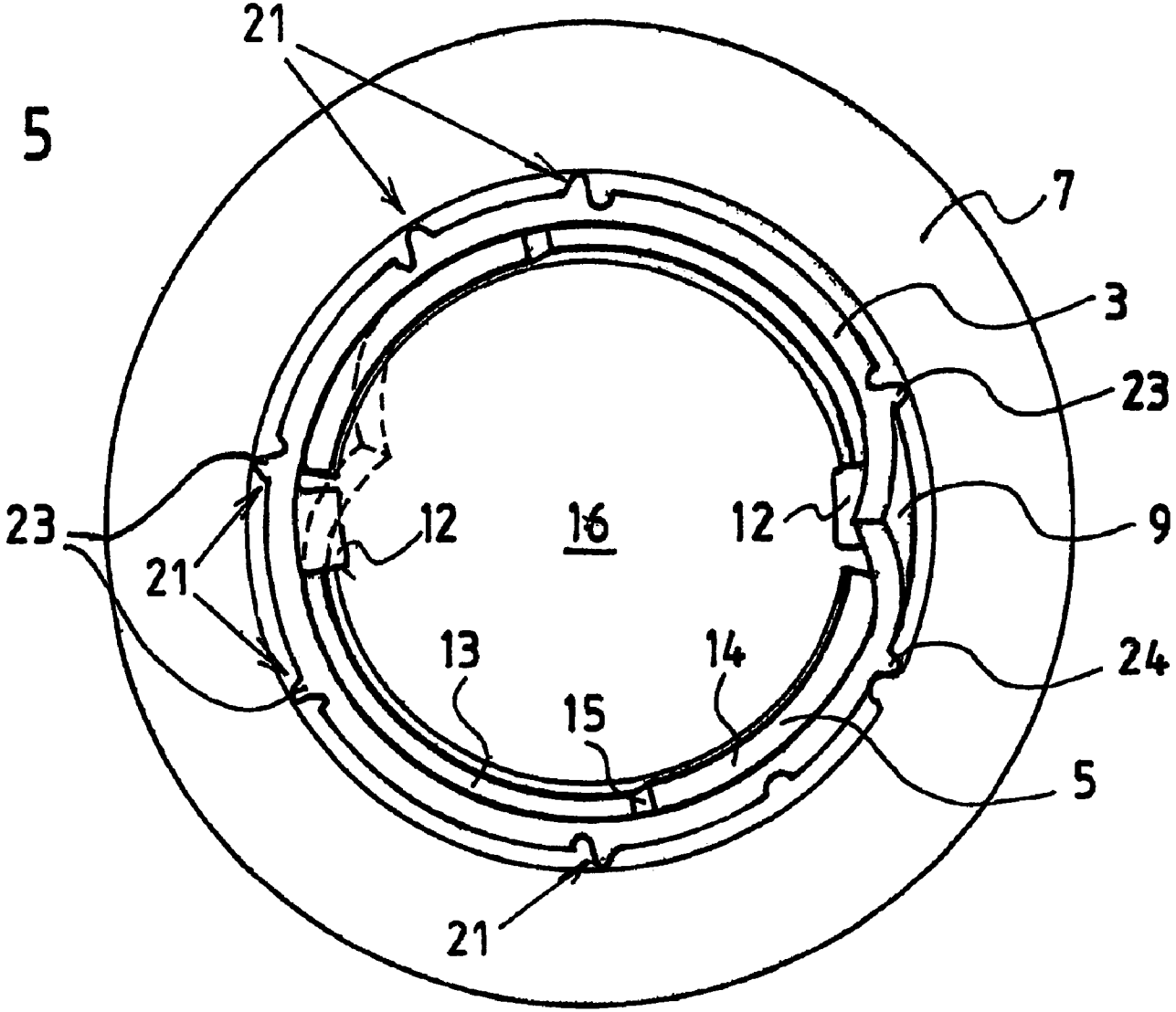
Figure 6:
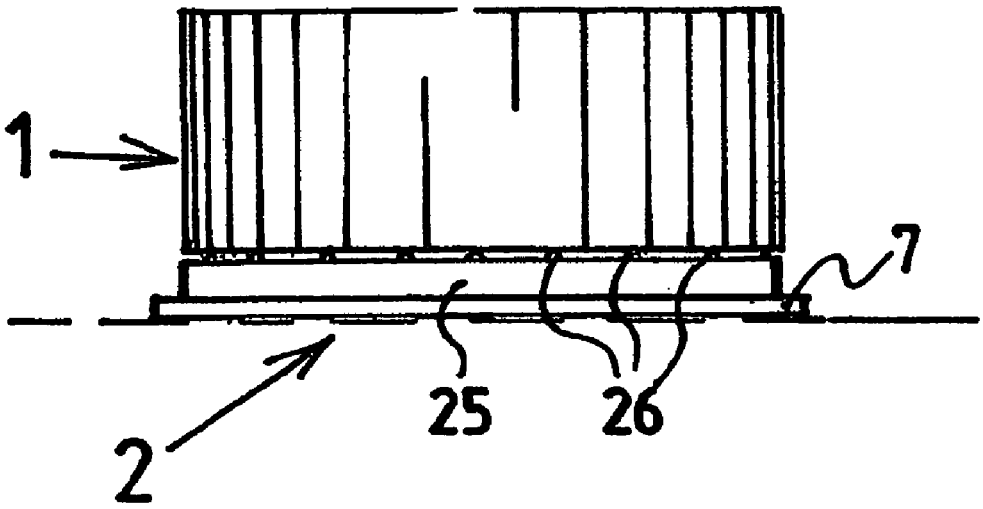
Figure 7:
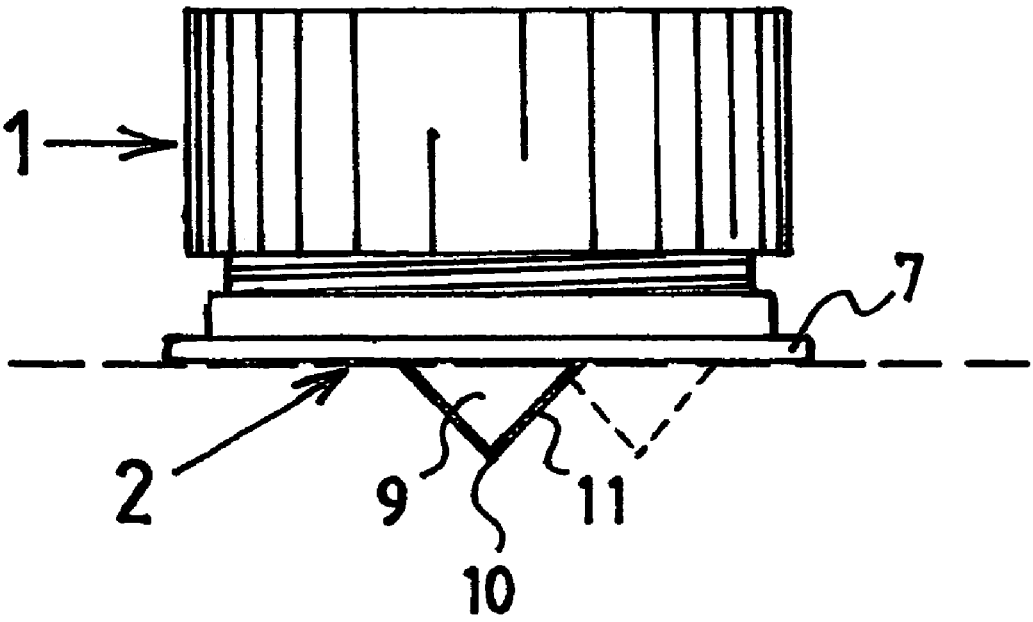
Figure 8:
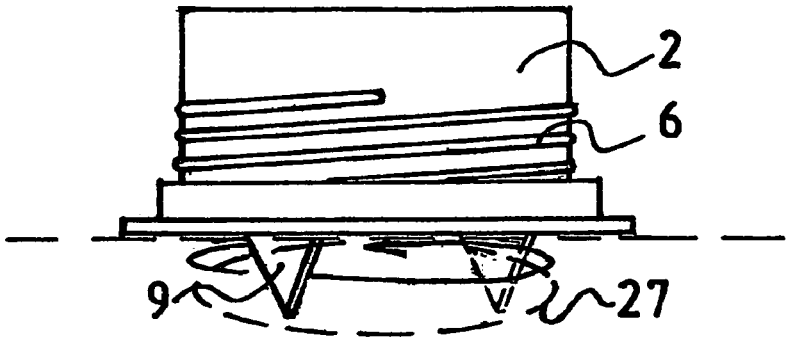
Figure 9:
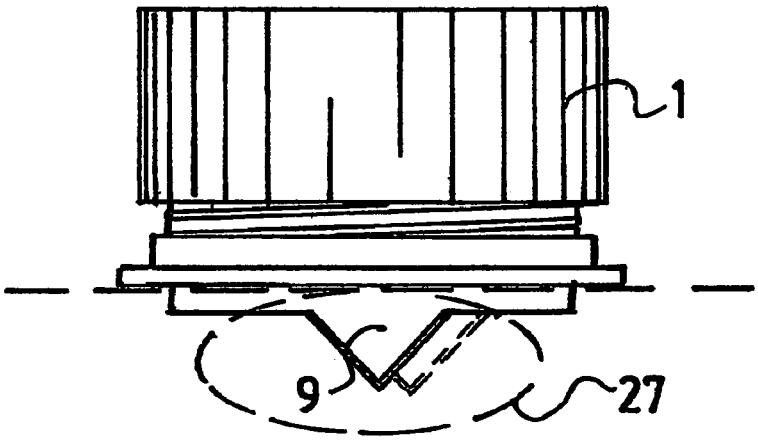
Figure 10:
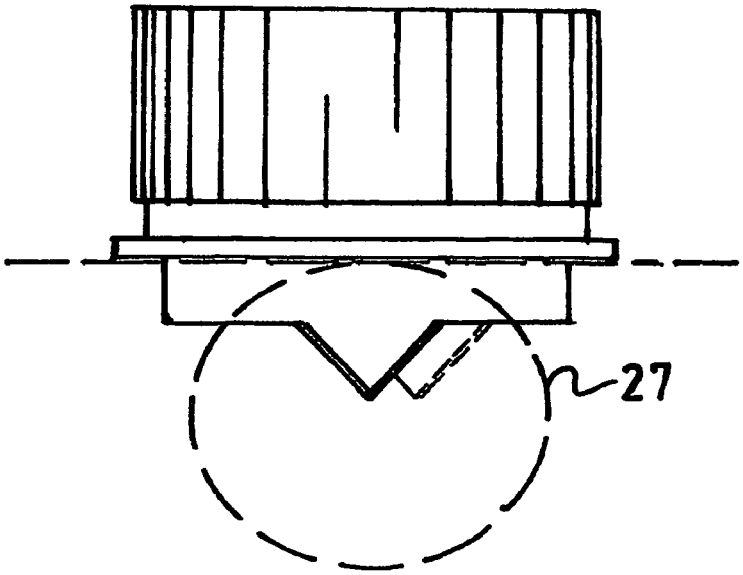
Figure 11:
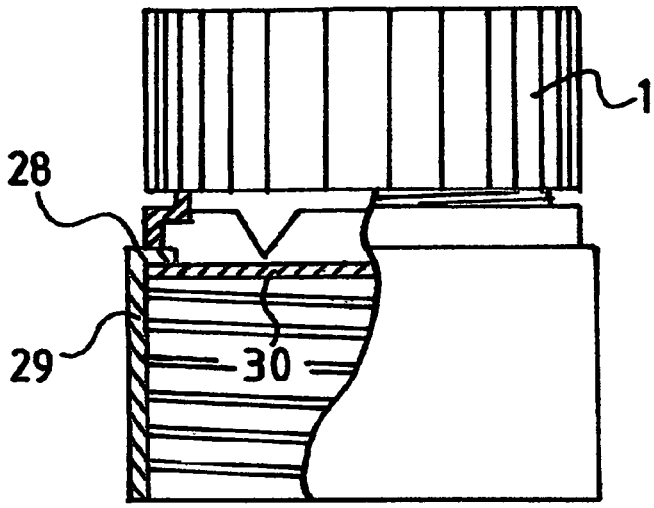
Figure 12:
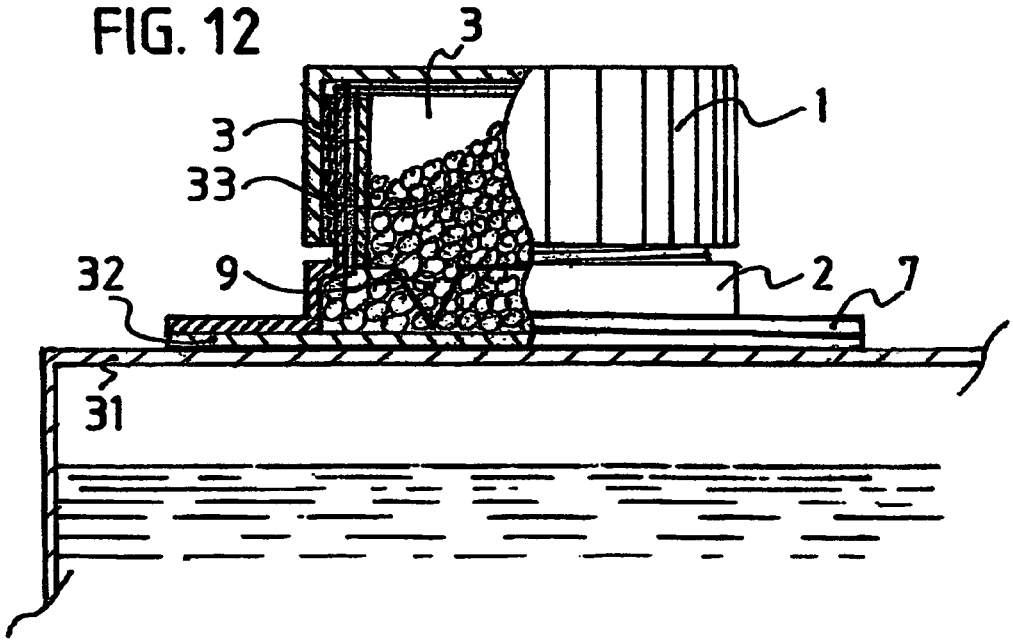
Figure 13:
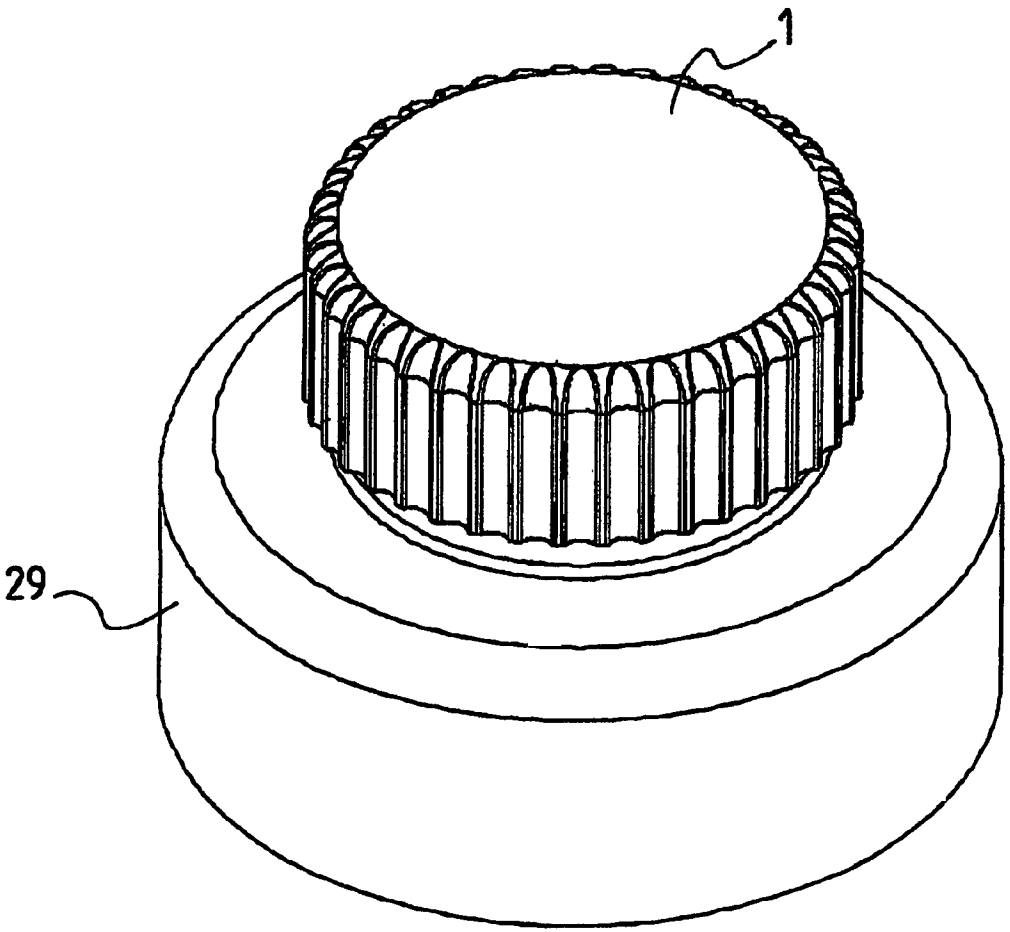
Figure 14:
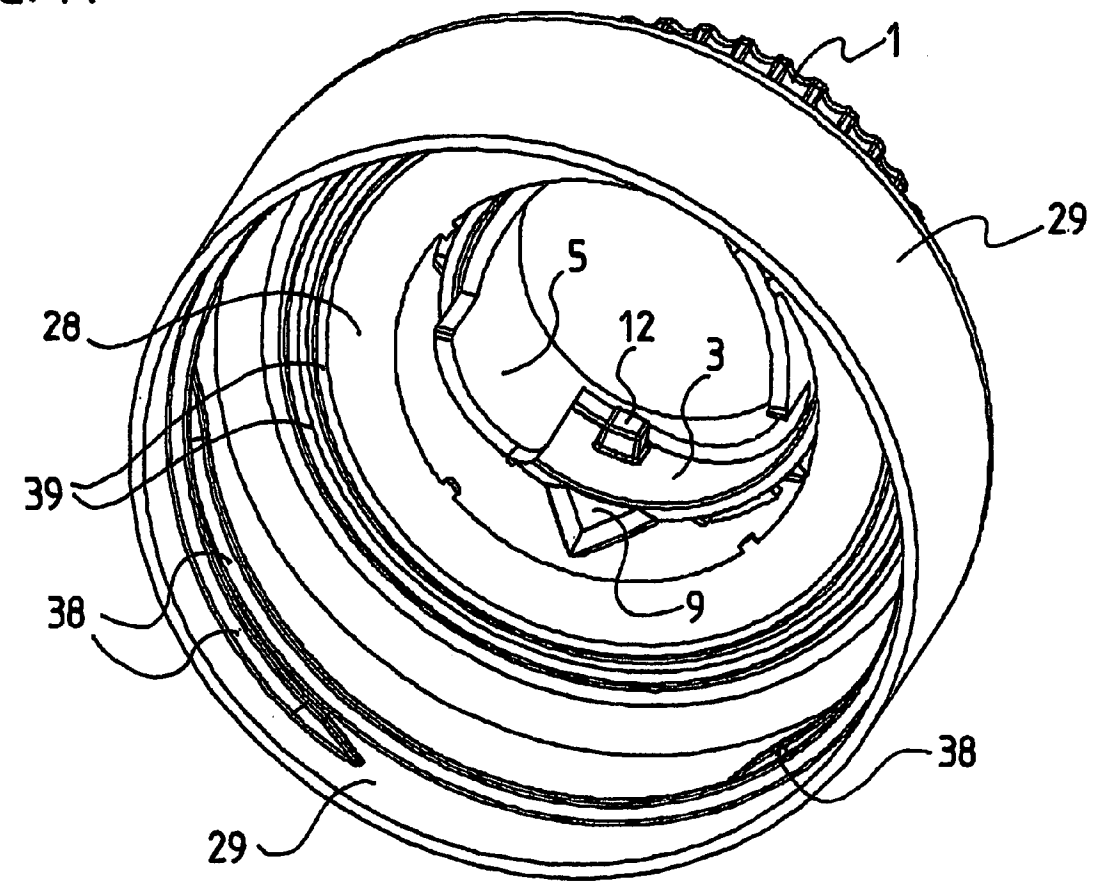
Figure 15:
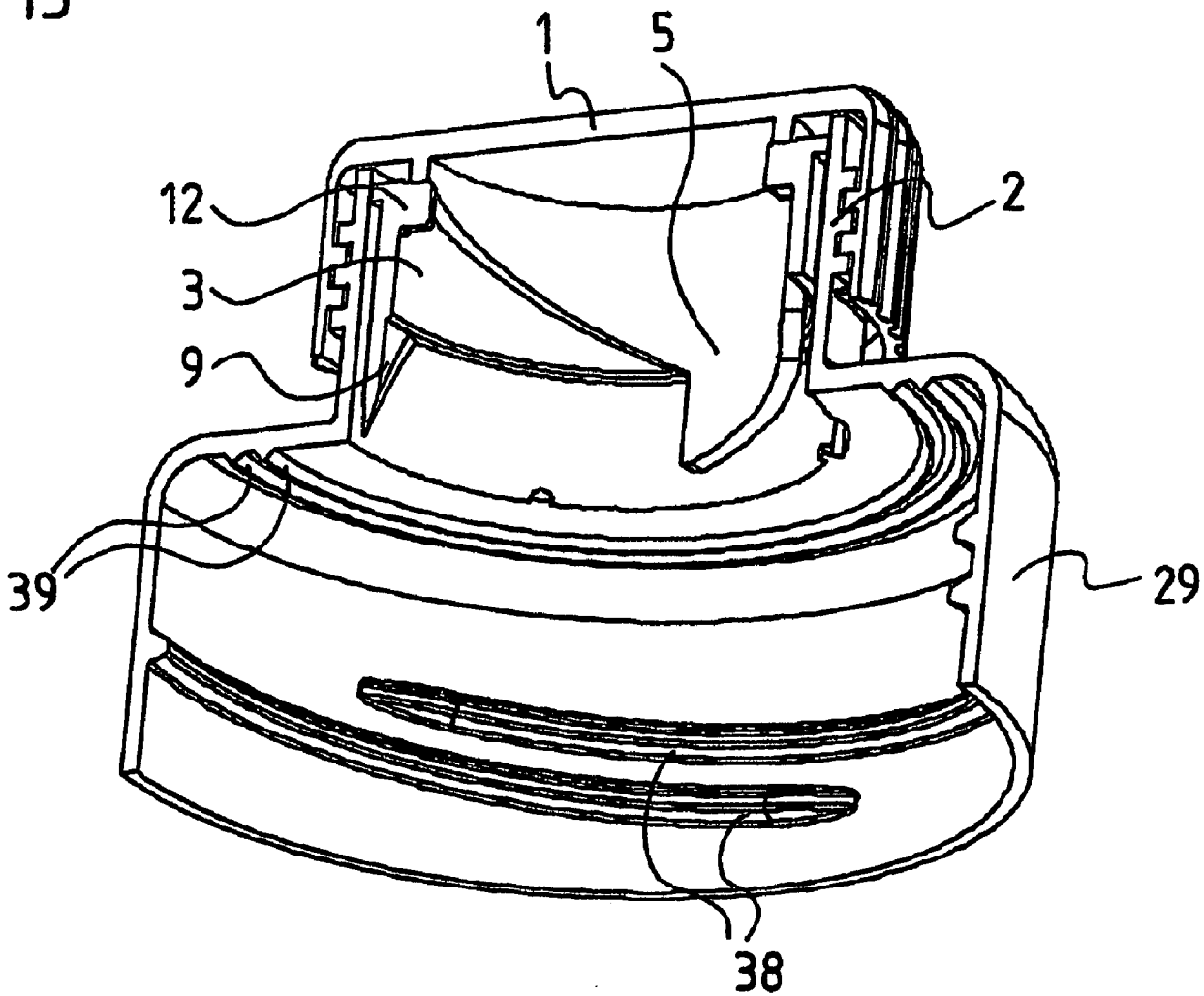
Figure 16:
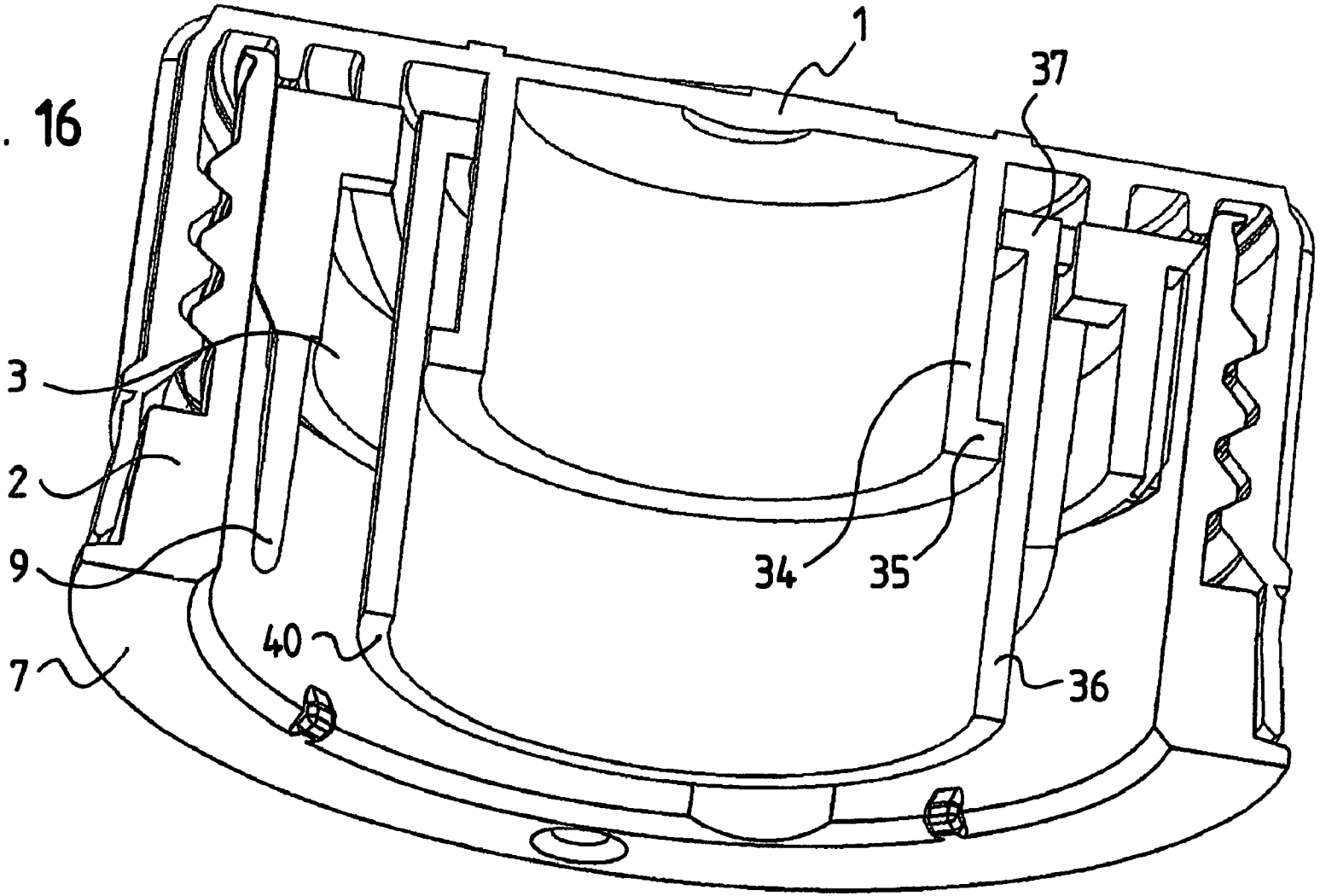
Figure 17:
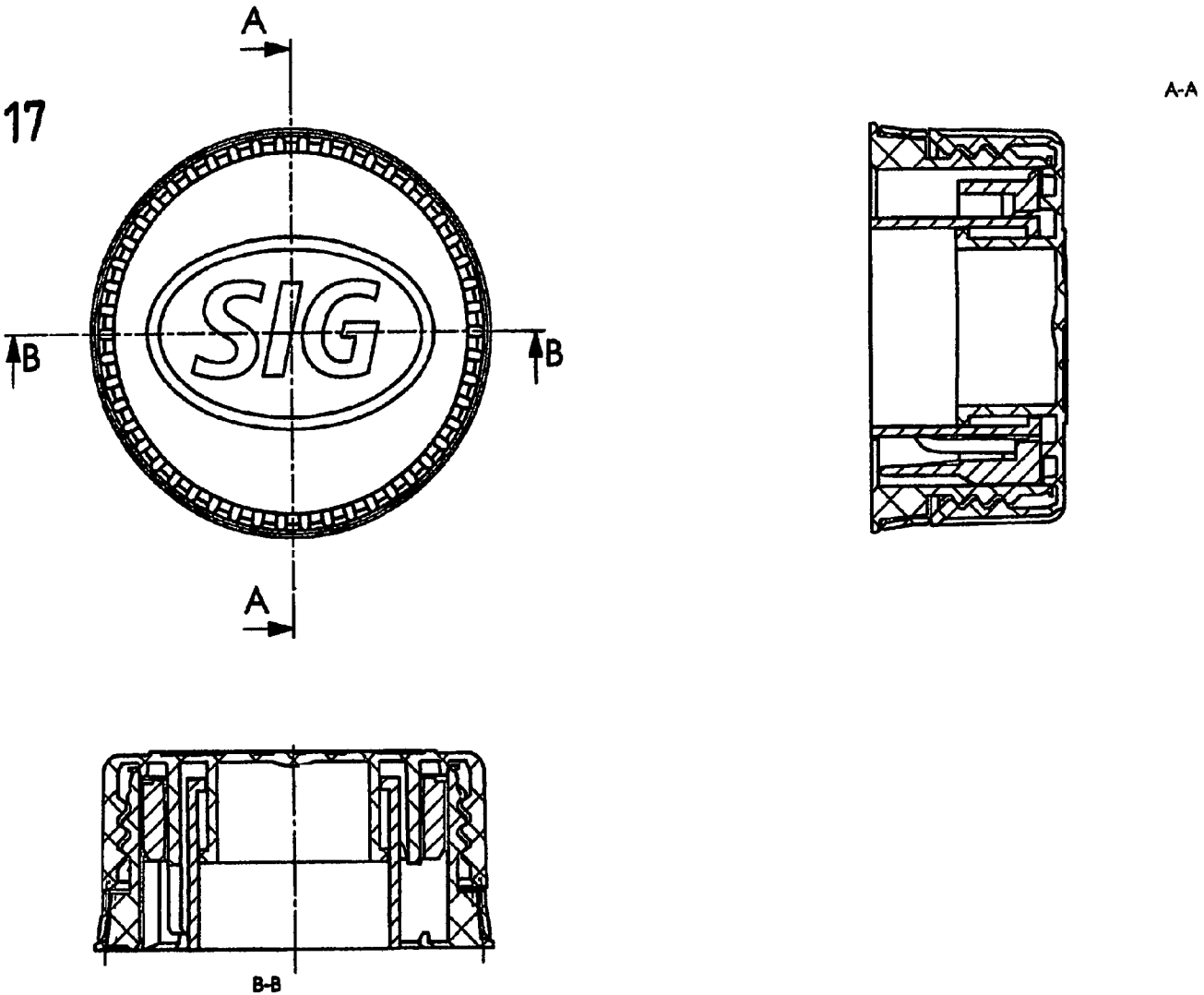
Figure 18:
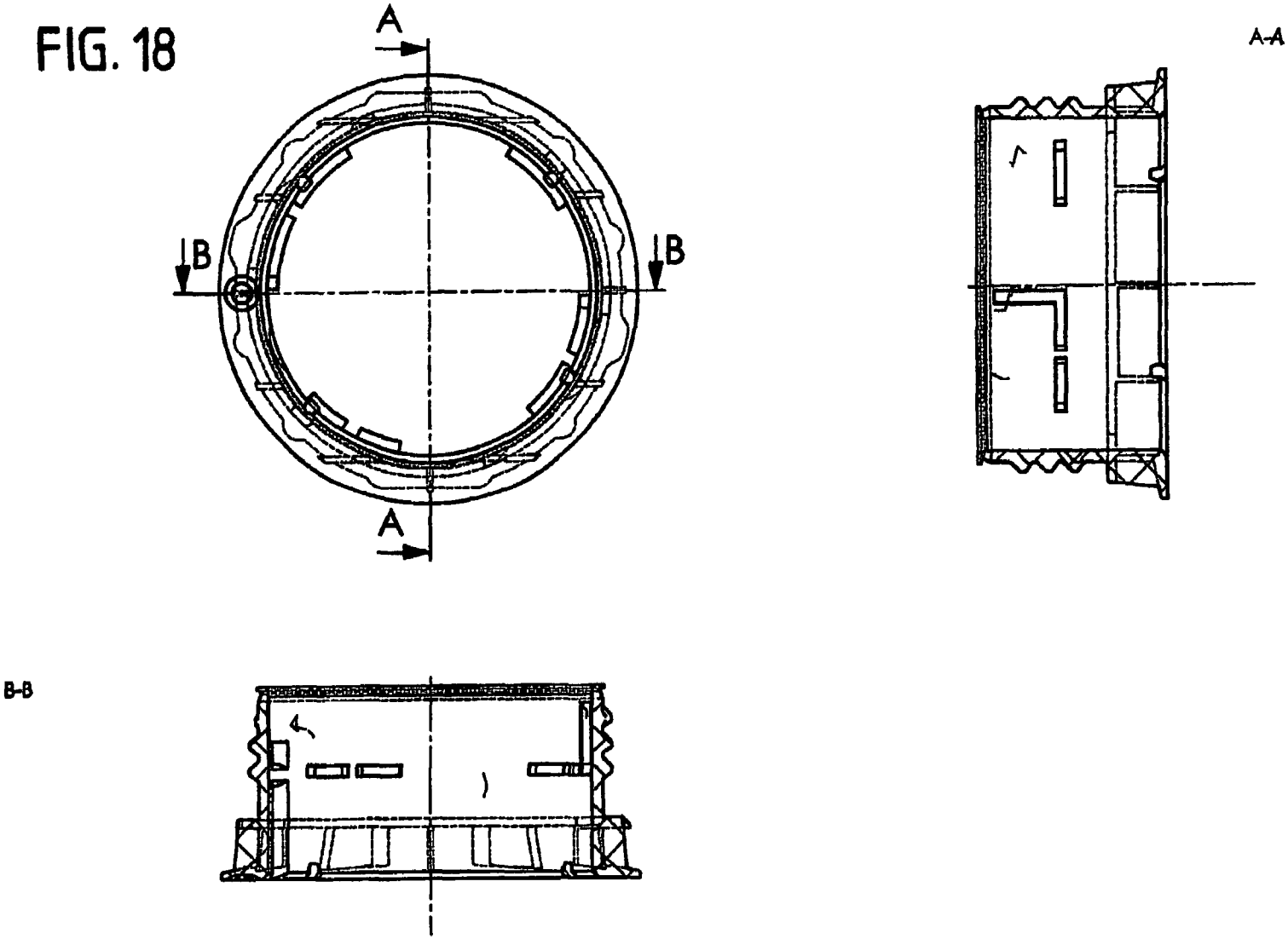
Figure 19:
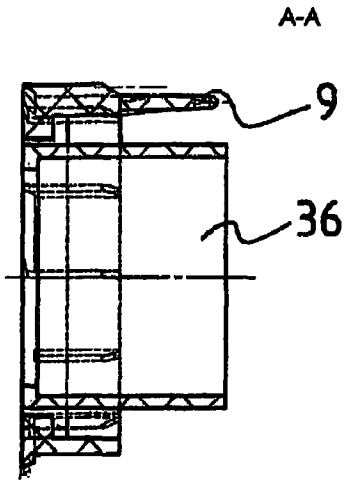
Figure 19:
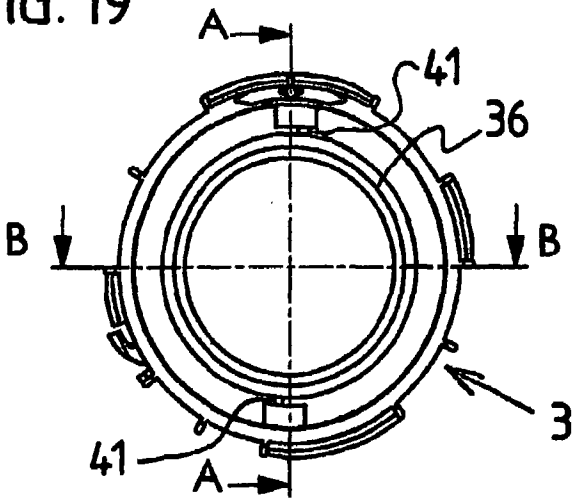
Figure 19:
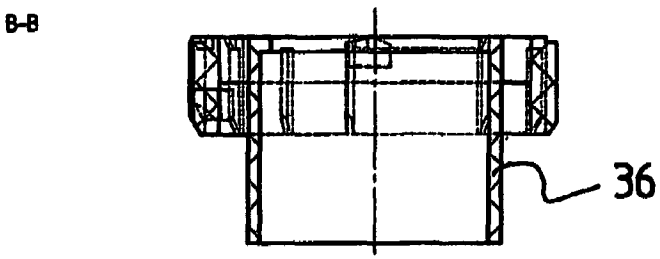
Figure 20:
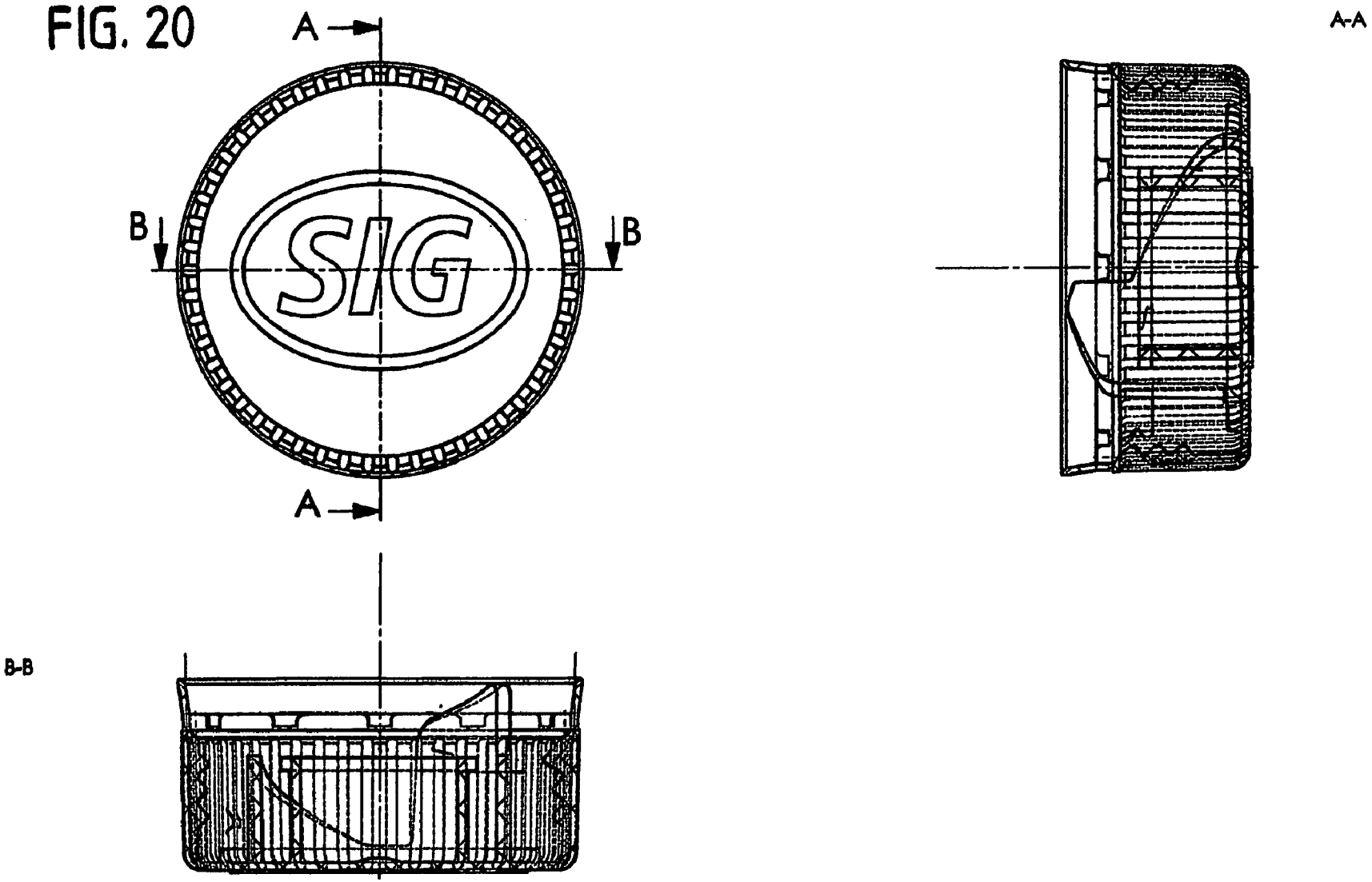
Figure 21:
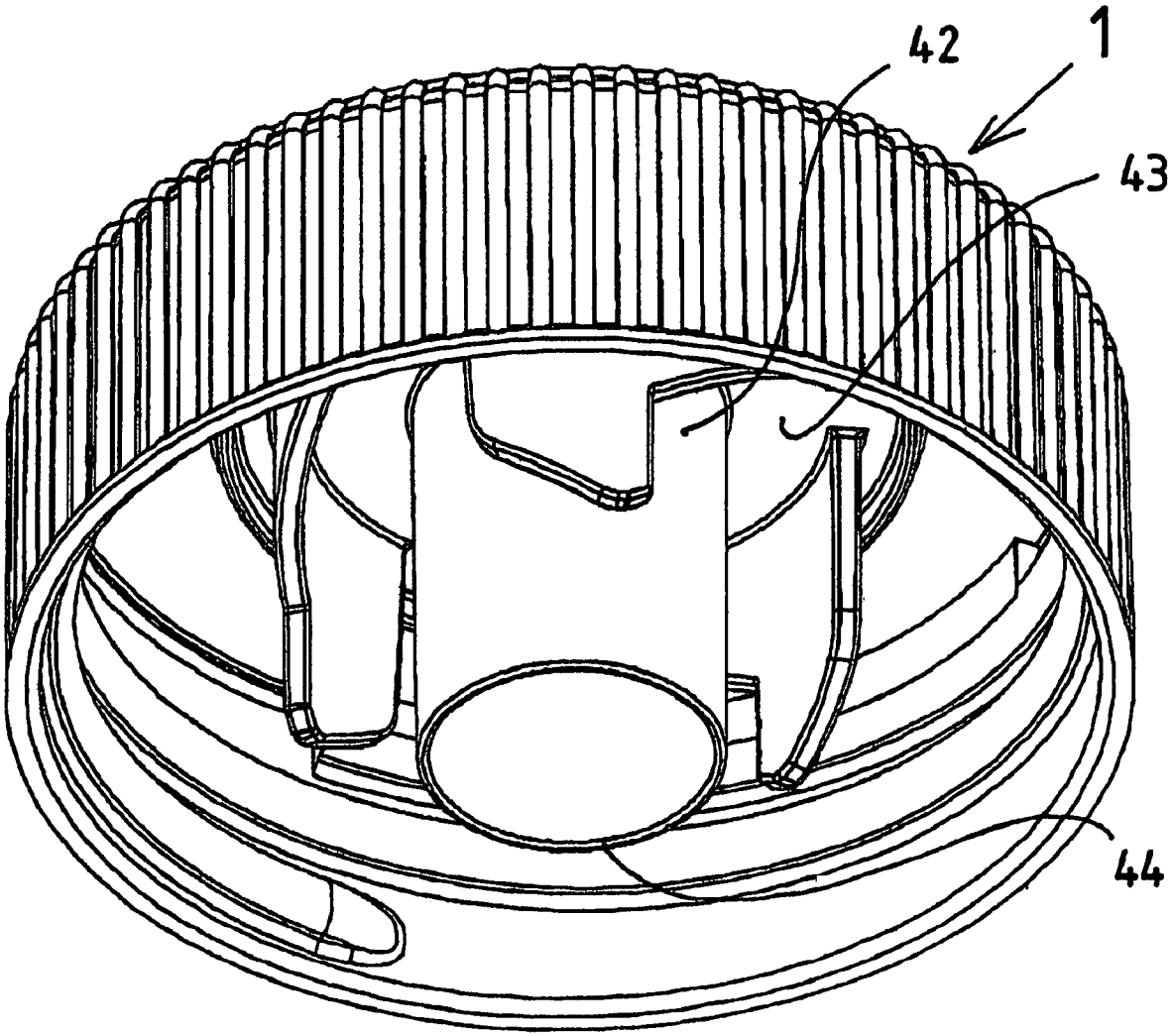
Figure 22:
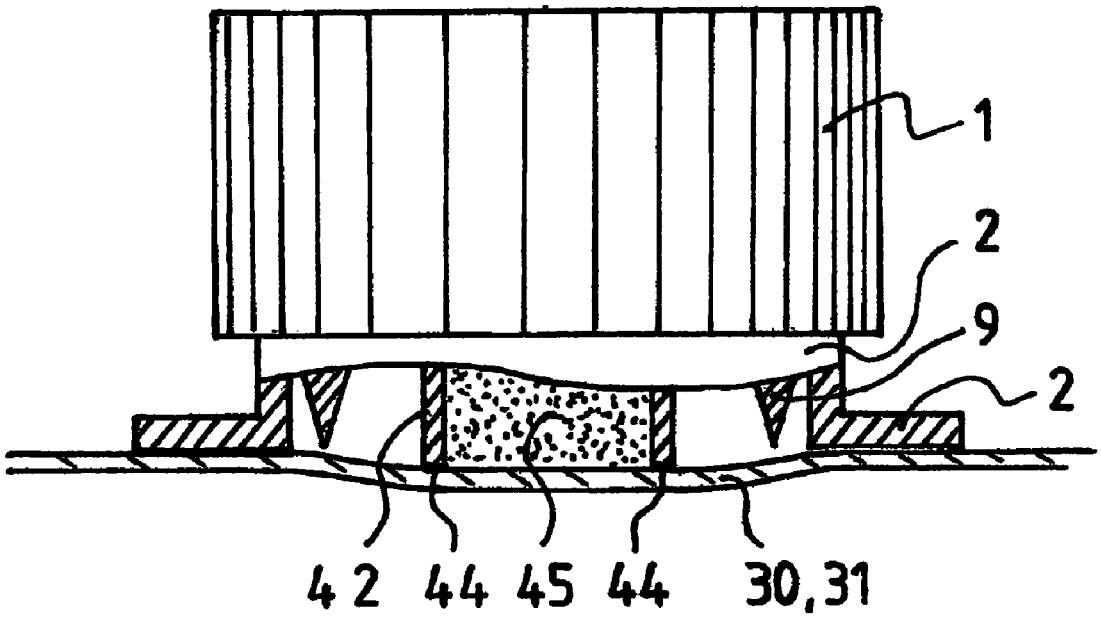

FIG. 1 the self-opener closure with its three components in a separated condition, in a perspective representation;

FIG. 2 the rotary cap of the self-opener closure in a perspective representation, seen roughly from below;

FIG. 3 the pour-out spout of the self-opener closure in a perspective representation, seen roughly from below;

FIG. 4 the self-opener sleeve of the self-opener closure in a perspective representation, seen roughly from below;

FIG. 5 the assembled self-opener closure in a plan view, seen from below;

FIG. 6 the assembled self-opener closure seen from the side, in the initial position of the self-opener sleeve;

FIG. 7 the assembled self-opener closure seen from the side; after a 90° opening rotation of the rotary cap and the axial pressing-down of the self-opener sleeve in the inside of the pour-out spout effected by way of this;

FIG. 8 the assembled self-opener closure seen from the side, after the completed horizontal rotation of the self-opener sleeve in the inside of the pour-out spout, and after removal of the rotary cap;

FIG. 9 the self-opener closure seen from the side, after renewed placing of the rotary cap for closing and the first phase of its rotating-on;

FIG. 10 the self-opener closure seen from the side, after renewed placing of the rotary cap for closure and after complete screwing-on of the rotary cap;

FIG. 11 the self-opener closure seen from the side in an embodiment form for screwing the whole closure onto a threaded spout of a container or a bottle;

FIG. 12 a self-opener closure for automatic metering of a separate substance, activated by opening the closure, seen from the side in a part section, welded onto a composite packaging;

FIG. 13 a variant of a self-opener closure with a metering chamber for screwing the whole closure onto a threaded spout of a container or a bottle, seen from outside;

FIG. 14 the self-opener closure according to FIG. 13 in a perspective view obliquely from below;

FIG. 15 the self-opener closure according to FIGS. 13 and 14 represented in a section;

FIG. 16 a self-opener closure with an additionally incorporated nipple for removing the film disk cut out by the self-opener sleeve, shown in section;

FIG. 17 a self-opener closure with an additionally incorporated nipple for removing the film disk cut out by the self-opener sleeve in a view from above with two section representations along the lines A-A and B-B of the figure with the view from above;

FIG. 18 the pour-out spout of the self-opener closure according to FIG. 17 in a view from above with two sectional representations along the lines A-A and B-B of the figure with the view from above;

FIG. 19 the self-opener sleeve and the nipple for removing the cut-out film disk of the self-opener closure according to FIG. 17 with two sectional representations along the lines A-A and B-B of the figure;

FIG. 20 the cap of the self-opener closure according to FIG. 17 with two sectional representations along the lines A-A and B-B of the figure;

FIG. 21 a cap of a self-opener closure with an integrated metering sleeve for metering a separate substance;

FIG. 22 a self-opener closure with a cap with a metering spout shown in a partly diametrical section with a packaging film welded on.

DETAILED DESCRIPTION OF THE DRAWING FIGURES

In FIG. 1 the self-opener closure with its three components is shown perspectively in a separated condition, wherein the view is obliquely from below onto the closure. On the right one recognises the rotary cap 1, in the middle the pour-out spout 2 and on the left the self-opener sleeve 3. Within the rotary cap 1 which here is designed as a threaded cap 1 and accordingly provided with an inner thread 4, as an essential feature one recognises two cylinder wall segments 5 arranged concentrically to the cap rotary axis on the inner side of its lid. These cylinder wall segments 5 serve as force transmission means so that on rotating the threaded cap 1 in the release direction, that is to say in the anti-clockwise direction seen from above onto the threaded cap 1 one may transmit a torque by this onto the self-opener sleeve 3. Moreover, and advantageously three identical cylinder wall segments may be provided concentrically to the cap rotary axis, since then the force is transmitted even more uniformly onto the self-opener sleeve as will yet be explained. The exact shape and formation of these cylinder wall segments 5 is deduced from further drawings. To the left next to the rotary cap 12 there is shown the pour-out spout 2. It forms essentially a hollow cylindrical spout or tube section which on its outer side is provided with an outer thread 6 which fits with the inner thread 4 of the rotary cap 1. On the lower side of the pour-out spout 2, in the shown representation, thus on the left side one recognises a radial projections 7 on the lower spout edge. With this projection 7 which at the lower end of the pour-out spout 2 forms a flange, the pour-out spout 2 is welded onto a composite packaging in the known manner, so that then the lower side of the flange lies on the composite material and is sealing connected to this. On the inner side of the pour-out spout 2 one recognises various guide webs 8 of which the one are L-shaped guide webs 17. The guide webs 8, 7 serve so that the self-opener sleeve is guided in the inside of the pour-out spout 2 in the desired manner, as will later be explained. To the very left in the picture one recognises the self-opener sleeve 3. This fits into the inside of the pour-out spout 2 and here comprises a single combined piercing and cutting member 9. This piercing and cutting member 9 here is formed as one piece on and with the lower edge of the self-opener sleeve 3. In the shown example it forms an isosceles triangle, wherein the tip 10 projecting downwards is sharpened and also the remaining sides of the triangle form sharpened edges 11. This triangle thus acts as a piercing cutter 9 which will yet be described in the following. In one advantageous variant which is particularly suitable for strong sealing films one may also provide two piercing cutters 9 in place of a single one, which then are integrally formed on the lower edge of the self-opener sleeve 3 lying diametrically opposite one another. Such a second piercing cutter 9 is here indicated dashed. With two piercing cutters 9 lying opposite one another in this manner it is achieved that on piercing the film, reaction forces acting on the sleeve are uniformly distributed and thus do not act at only one location. With this it is achieved that the sleeve 3 does not twist in the spout 2. At the upper edge of the self-opener sleeve 3, and specifically on its inner side one recognises a catching cam 12. This belongs to the force transmission means and together with the diametrically oppositely lying equal catching cams, which however may not be seen here, accommodates the torque exerted by the rotary cap 1 and transmits this to the self-opener sleeve 3 so that this co-rotates with the rotary cap 1. In place of individual cams 12 one may also arrange a continuous web, thus a connection between both cams 12. The force transmission is then secured in the sense that no cams may slip off from any guide ribs. The throughflow however is inhibited somewhat by this web. On the outer side of the self-opener sleeve 3 one may see guide ribs 21 which serve for forcing the self-opener sleeve 3 into a certain movement under the influence of the torque acting on them. These guide ribs 21 are formed U-shaped in that they continuously consist of a horizontal section 22 running on the outer wall of the self-opener sleeve and two limbs 23 running vertically downwards from this.

FIG. 2 firstly shows the rotary cap 1 of the self-opener closure in a perspective representation seen roughly from below and shown separately. This rotary cap 1 is equipped with two oppositely lying cylinder wall segments 5 arranged concentrically to the rotation axis of the rotary cap 1 and are integrally formed on the inner side of the cap lid 16. As already mentioned above there may also be three cylinder wall segments which are arranged distributed over the circumference. The cylinder wall segments 5 are in any case all identical, but are specially shaped. The lower edges of the segments 5 specifically comprise two oppositely ascending sections, wherein these ascending sections 13, 14 are displaced axially to one another with respect to the rotary cap 1 so that a step 15 is formed in the middle. The first edge section 13 seen in the anti-clockwise direction 13 begins to ascend from the level of the cap lid 16 and ends after a circumferential section of 90° of the cylinder wall segment 5, in the case of three segments after a circumferential section of 60°, wherein over this section it ascends to about ⅔ of the height of the cylinder wall segment 5. This height corresponds roughly to 1.5 times the thread height on the rotary or threaded cap 1. Following this section with an ascending edge is a vertical step 15 which extends up to the height of the lower edge of the rotary cap, which at the same time corresponds to the height of the cylinder wall segment 5 itself. The counter-ascending edge section 14 of the cylinder wall segment 5 begins to ascend at the level of the lower beginning of the step 15 and extends up to the upper end of the step 15. At the same time this edge section 14 extends by somewhat less than 90° along the circumferential direction of the cylinder wall segment 5 which thus as a whole extends by approximately 180°. In the embodiment with three cylinder wall segments the edge segment 14 extends accordingly by somewhat less than 60° and a single cylinder wall segment then extends by approximately 120°. Between the cylinder wall segments 5 and the inner wall of the rotary cap 1 there thus remains so much space that here on the one hand the wall of the pour-out spout 2 as well as on the other hand the self-opener sleeve 3 arranged in the inside of the pour-out spout 2 may find space.

FIG. 3 shows the pour-out spout 2 of the self-opener closure in a perspective representation seen roughly from below in a separate representation. On its outer side the wall of the pour-out spout 2 is equipped with an outer thread 6 onto which the inner thread 4 of the rotary cap 1 may be screwed. With this the outer thread 6 extends only by three windings from the lower edge of the pour-out spout 2, whilst the wall thereabove remains free or smooth. On the inner wall of the pour-out spout 2 there are integrally formed guide webs 8, 17. It is the case of two L-shaped guide webs arranged on the inner wall at opposite locations and two guide webs 8 which are arranged between these, likewise at opposite locations and running horizontally on the pour-out spout 2. In the shown representation of each guide web type 17, 8 only one however may be seen. In the embodiment with three cylinder wall sections accordingly there are arranged in each case three of each type of guide web distributed about the circumference. At the lower edge of the pour-out spout 2 one may recognise the radial projection 7 which forms a flange with whose lower side the spout 2 is welded onto the composite packaging 20. This cam acts as an abutment cam 20 for the rotating self-opener sleeve 3 as will yet be explained in the course of the description.

FIG. 4 shows the self-opener sleeve 3 separately and obliquely from below, however shown in a rotational position different than in FIG. 1. The self-opener sleeve 3 is dimensioned in diameter such that it fits into the inside of the pour-out spout 2, wherein the guide ribs 21 in each case come to lie at those locations in the pour-out spout 2 where this has no guide webs 8, 17. In the shown representation one has a view from the outside of the individual piercing cutters 9. A second piercing cutter 9 is here shown dashed. Above the piercing cutter 9 there is arranged a U-shaped guide rib 21. Its one vertical limb 23 extends not quite up to the lower edge of the sleeve 3, as is likewise the case for all other vertical guide rib sections 23 with the single exception, specifically that the limb 24 visible here which if from one looks from above or here from below onto the self-opener sleeve 3 proceeds the piercing cutter 9 in the anti-clockwise direction. This section 24 thus reaches up to the lower edge of the self-opener sleeve 3 and has the function that after a completed horizontal movement of the self-opener sleeve 3 it abuts on the abutment cam 20 on the pour-out spout 2 shown in FIG. 3 and thus limits the rotation of the sleeve 3 in the inside of the pour-out spout 2.

FIG. 5 shows the self-opener closure in the assembled condition seen directly from below. One firstly recognises the flange-like projection 7 and in the inside of the pour-out spout 2, the concentrically inserted self-opener sleeve 3 as well as the likewise concentrically arranged cylinder wall segments 5 on the inner side of the lid 16 of the rotary cap 1. One recognises the guide ribs 21 on the self-opener sleeve 3 and the piercing cutter 9 as well as the optional second piercing cutter drawn dashed. Furthermore one recognises the guide webs 21 on the outer wall of the pour-out spout which alternate about the whole circumference. The two diametrically opposing catching cams 12 are also visible. It is dear that in place of mere catching cams 12 as shown here a diametrically continuous web may assume their function. A bridge-like web which connects the two catching cams 12 shown in the drawing has the advantage that the self-opener sleeve may be injected from the middle of the web. Specifically one then has an injection point which generally simplifies plastic injection [moulding], and a greater strength of the injection part than an injection [moulding ]via so-called side gates, thus laterally arranged injection nozzles. Such are required with the shown design. The part shown in FIG. 5 is injected from two injection nozzles lying opposite one another and the injected plastic must run together in the injection tool cavity and intimately connect. The design without a web however has the advantage that the pour-out spout remains free and does not inhibit the outflow. According to application it is therefore the case of considering the advantages and disadvantages of a design with or without a web.

In FIG. 6 there is shown the assembled self-opener closure seen from the side, and specifically in the initial position, that is to say before its opening for the first time. In the initial position one merely recognises the rotary cap 1 and the lower part of the pour-out spout 2, specifically its lower radial projection 7. At the lower edge of the rotary cap 1 this as shown here may comprise a guarantee strip 25 which is connected to the rotary cap 1 via a number of thin material bridges 26. This guarantee strip 25 on placing on the rotary cap 1 for the first time is pushed over a special bead which is circumferential on the pour-out spout 2 below its outer thread. The bead which however may not be seen here for this comprises a rounded upper edge and a sharp-edged lower edge so that the guarantee strip 25 when it is pushed over this bead once may not be pulled back upwards over the bead since it acts as a barb, but the guarantee strip 25 snugly encloses the pour-out spout below this bead. For opening the closure that is to say for rotating off the rotary cap 1, firstly the guarantee strip must be torn away with the breakage of the material bridges 26. Only then can the rotary cap 1 be rotated and screwed from the spout 2.

FIG. 7 shows the assembled self-opener closure seen from the side, after the axial or vertical pressing-down of the self-opener sleeve in the inside of the pour-out spout 2. The piercing cutter 9 now projects completely beyond the lower edge of the flange-like projection 7, likewise the approximately diametrically opposite second piercing cutter 9 shown dashed if such a second piercing cutter 9 is present. After the guarantee strip has been removed the rotary cap 1 seen from above may be rotated in the anti-clockwise direction. Accordingly in the case of a threaded cap 1 this on the pour-out spout moves upwards. At the same time the ascending edge section 13 at its inner-lying cylinder wall segments 5 acts on the catching cams 12 on the applied self-opener sleeve 3 and presses this downwards. The piercing cutter or piercing cutters 9 step into action and the same thing is effected as opening a can with a can opener in the first phase. The film or composite packaging is pierced in a purely vertical movement to it at one location or, in the case of two piercing cutters 9, at two locations. This is very essential since if the film is firstly pierced only once then afterwards may a clean cut achieved with one cutting movement. This self-opener closure thus makes use of the effect of a can opener. Just as also with a can opener for a can firstly the sheet metal of the can is pierced vertically in a defined manner and only afterwards does one begin with the cutting-open of the lid of the can along the edge of the can, here too firstly with a purely vertical or axial movement of the individual piercing cutter 9 or both oppositely lying piercing cutters 9 the film lying therebeneath is pierced. The torque applied onto the rotary cap 1 is thus converted into a purely axial movement of the self-opener sleeve 3 and thus the applied force is firstly concentrated on purely penetrating the film or composite material, in a manner which until now was not the case with conventional self-opener sleeves. For this the tip of the piercing cutter 9 is specially sharpened and the edges 11 of the piercing cutter 9 pointing in the circumferential direction are sharpened so that the tip on piercing widens the produced hole in the film or composite packaging on both sides in a "seamless" manner. After piercing downwards, the individual piercing cutter 9 or, in the case of two piercing cutters 9, both piercing cutters 9 assume the position shown here and thus project downwards beyond the projection 7 on the pour-out spout 2. In the meantime the rotary cap 1 has been rotated by 90° in the opening direction and at the pour-out spout 2 has been screwed a bit further upwards, but may not yet be removed. In their inside the edge sections 13 of the cylinder wall sections 5 have in the meantime likewise pivoted by 90° with respect to the self-opener sleeve 3. The self-opener sleeve 3 with its guide ribs 21, specifically with their vertical sections 23, 24 on the vertical sections 18 of the guide webs 8 on the pour-out spout 2, is firstly unrotatably guided. For this reason the sleeve is abutted vertically downwards by the edge sections 13 of the cylinder segments 5 until the ends of the edge sections 13 have reached the inwardly pointing catching cams 12 on the self-opener sleeve 3. The self-opener sleeve 3 is now displaced so far downwards with respect to the pour-out spout 2 that its vertical guide rib sections 23, 24 are displaced below the vertical sections 18 of the guide webs 8 on the pour-out spout 2. For this reason the self-opener sleeve 3 may now be rotated in the pour-out spout 2.

If one thus rotates the rotary cap 1 further in the anti-clockwise direction, then the steps 15 at the lower edges of the cylinder wall segments 5 come into action and set the self-opener sleeve 3 into a horizontal rotation about is rotary axis in that these steps 15 push the catching cams 12 in front of then. The self-opener sleeve 3 at the same time is guided along the horizontal sections 22 of its guide ribs 21 and those 19 of the guide webs 8 on the pour-out spout 2. This rotation in the horizontal plane has the effect that the piercing cutter 9 now functions as a pure cutting member in that the sharp edge 11 which points in the anti-clockwise direction cleanly cuts open the pierced film or composite packaging. The cutting rotation in the case of an individual piercing cutter extends over almost 360°. Just before reaching a complete revolution, thus about 5° before reaching a 360° rotation, the one vertical section 24 of that guide rib 21 which is arranged over the piercing cutter 9 comes to abut on the abutment cam 20 on the pour-out spout 2 and the rotation of the self-opener sleeve 3 is stopped. At the same time the rotary cap 1 in this position as a result of the threaded connection to the pour-out spout 2 has gained so much height with respect to the pour-out spout 2 that it is released from the thread and may therefore be pulled off vertically or lifted away. The self-opener sleeve 3 rotated by almost 360° at the same time has cut a disk out of the film or composite material and as a result of its rotation by approximately 360° this disk is pivoted downwards and releases the throughflow. FIG. 8 shows this just described movement phase of the self-opener sleeve 3 seen from the side, and its end position after the completed horizontal rotation of the self-opener sleeve 3 in the inside of the pour-out spout 2, as well as indicating the cut-out film disk 27 in a pivoted-away condition drawn in dashed. The rotary cap 1 has been removed and the contents of the composite package may now be poured out unhindered through the pour-out spout 2 by pivoting the packaging. If the self-opener sleeve 3 is equipped with two approximately opposite piercing cutters 9—here a second piercing cutter has been shown dashed—then the geometry with the vertical section 24 of that guide rib 21 which is arranged over the piercing cutter 9 and comes to abut on the abutment cam 20 on the pour-out spout 2 is selected such that a rotation of the self-opener sleeve 3 is only possible about 180°. Because the two piercing cutters 9 are not arranged lying directly opposite one another, the one piercing cutter 9 then overcuts a section through which the second has already cut, whilst at the end this second one leaves a small section of the film uncut about which the film disk 27 which has been cut out in such a manner may be pivoted away.

If one does not pour out everything immediately then the closure may be closed again. For this the rotary cap 1 may again be placed on the pour-out spout 2 and the closure screwed closed. FIG. 9 shows the self-opener closure seen from the side after this renewed placing of the rotary cap 1 and the first phase of the closure screwing. With this closure screwing of the rotary cap 1 after opening for the first time the edge sections 14 of the cylinder segments 5 with counter ascent come into action. On screwing down the rotary cap 1 after the first opening they strike over the catching cams 12 arranged on the inner edge of the self-opener sleeve 3 and push the self-opener sleeve 3 firstly a first bit further into the pour-out spout 2 and thus into the container, by which means the previously cut-out disk 27 shown dashed is pivoted further into the inside of the container as is shown in FIG. 9.

On screwing further in the course of the first screwing-down of the rotary cap 1 these edge sections 14 are rotated beyond the catching cams 12. After a rotation by almost 180°—with three cylinder wall sections accordingly after about 120°—and in the course of this a further effected downwards movement of the rotary cap 1 on the pour-out spout 2, these edge sections 14 of the cylinder wall sections 5 strike over the catching cams 12 again and displace the self-opener sleeve 3 in a second push again a bit further into the composite packaging container. FIG. 10 shows the self-opener closure seen from the side in this end position that is to say after the renewed placing and complete screwing-down of the rotary closure 1. With this the cut-out film disk 27 on renewed screwing-down of the rotary cap 1 after its opening for the first time is pivoted far into the container in a reliable manner and thus completely releases the pour-out spout 2, that is to say the disk 27 which has been pivoted down no longer projects into the throughflow region of the pour-out spout 2 or into the jet of liquid arising when pouring out. Rather it is pivoted far downwards into the container and is kept in this position by the piercing cutter 9 pushed downward in two pushes.

It is to be understood that the rotary cap 1 does not necessarily need to be a threaded cap, but the principle this self-opener closure also functions with a rotary closure which forms a bayonet closure with the pour-out spout. Then the pitches of the edge sections of the cylinder wall segments on the inner side of the cap lid merely need to be formed less steeply. Furthermore the self-opener closure on the outside may have differently designed rotary caps. Thus in the case of a threaded cap a knurled or ribbed grip surface is advantageous so that by hand it may also easily be rotated against the resistance which arises on piercing and cutting the film. For particularly strong composite materials and films or for particularly large dimensioned embodiments of this closure the rotary cap as an outer shape in outline may have a square, hexagonal or octagonal shape so that it may be opened with a spanner or adjustable spanner. An embodiment in which the threaded cap upper side comprises at least one diametric groove so that it may be opened with the help of a coin or a square steel bar applied transversely on it is also conceivable. Furthermore it may also have an upper side on which there is formed a diametrically upwardly projecting web on which the rotary cap may be particularly easily rotated by hand and also larger torques may be exerted, particularly if also, for example a wrench or pliers are used.

FIG. 11 shows an alternative embodiment of this self-opener closure for assembly on a neck of a container or a bottle. At the same time the lower part of the closure is shown in a section along the rotation axis of the screwed-on rotary cap. The pour-out spout 2 in this case at its lower side does not comprise a projecting edge but via a shoulder 28 goes into a threaded sleeve 29 which may be screwed onto the outer thread of a neck of a bottle or onto the pour-out spout of any receptacle. The film 30 to be pierced and cut open as a separate part may be welded from below onto the shoulder 28 or may be already located at the top on the non-shown opening of the neck of the bottle with an outer thread, with which it is welded so that the contents of the bottle are sealed.

FIG. 12 here shows a further particular variant of the self-opener closure. This closure here is seen in a view from the side, represented in a part section, and welded onto a composite packaging 31. After the self-opener closure has been manufactured and assembled, which is effected by machine in that the threaded cap 1 is also pressed onto the self-opener closure 2 and the self-opener sleeve 3 is applied, subsequently the closure in the tipped position is filled with a separate substance 33 which is to be mixed with this before use of the contents of the composite packaging. This substance may for example be a drinks powder, a concentrate or another granulate, powder or fluid capable of being poured. The self-opener closure filled with this substance is thereafter closed in that a film laminate disk 32 is welded or adhesed onto the lower side of the flange or the extension 7 on the pour-out spout 2. This film disk 32 may consist of the same material as the composite packaging 31 itself or also another sealing laminate film with an aluminium or plastic layer. The self-opener closures filled with a substance are then welded or adhesed onto a composite packaging 31 with their lower film disk 23. If then the closure is opened for the first time then the tip of the piercing cutter 9 of the self-opener sleeve 3 not only pierces the composite packaging 31 but before this also the film disk 32. On further rotation of the closure cap 1 the piercing cutter 9 cuts a round disk out of the film disk 32 and the composite packaging, and folds this into the inside of the composite packaging 31. This has the result that the substance 33 in the inside of the self-opener closure falls into the composite packaging. The composite packaging may then be shaken somewhat for an improved mixing of the substance with its contents, for which the threaded cap may be screwed on again as the case may be. Afterwards the contents are ready for use and after opening the closure may be poured out once again.

In yet another embodiment the inner side of the self-opener sleeve may be coated with a certain soluble substance. In this case on pouring out there is effected an automatic metering of this separate coating substance in that it is washed away by the pour-out jet and entrained.

FIG. 13 shows an embodiment variant of a self-opener closure with a metering chamber for screwing the whole closure onto a threaded spout of a container or a bottle, seen from the outside. It consists of a lid cap 1 as well as the pour-out spout lying thereunder with a threaded sleeve 29 integrally formed thereon for screwing the closure onto a container. FIG. 14 provides a view onto this embodiment variant from below. One recognises the thread ribs 38 on the threaded sleeve 29 and two concentric slots 39 on the underside of the shoulder 28 between the threaded sleeve 29 and the pour-out spout 2. A circular disk shaped film may be placed onto these slots 39, wherein its diameter corresponds to the inner diameter of the threaded sleeve 29 so that the shoulder may be completely covered by it. This film may then be welded with the slots 39 which may be effected by usual ultrasound welding. Before this the space within the pour-out spout 2 may be filled with a separate substance so that the welded-on circular disk shaped film sealingly encloses this substance. In the shown view of the self-opener closure one may still see the upper edge of the lid cap 1, then within the pour-out spout 2 the cylinder wall segments 5 on the lower side of the lid cap 1 and arranged around this the self-opener sleeve 3 with its at least one piercing cutter 9 as well as one of its catching cams 12. In FIG. 15 the self-opener closure is still shown in the sectional representation. If then a film disk is welded onto the slots 39 from below and the cap lid 1 is rotated in the direction of opening for the first time, the self-opener sleeve 3 is firstly pushed axially downwards and the piercing and cutting member 9 pierces open the film. Afterwards the self-opener sleeve 3 is set into a pure rotation about its rotary axis and at the same time the cutting member 9 cuts the film along the inner edge of the pour-out spout 2. The substance held above the film until now by way of this falls into the inside of the container and is mixed with its contents.

FIG. 16 shows a further particular variant of the self-opener closure. The closure shown here has an additionally incorporated nipple for removing the film disk cut out by the self-opener sleeve. Here one sees the closure slightly obliquely from below, with the previously described parts of the lid cap 1, pour-out spout 2 and self-opener sleeve 3. On the lower side of the lid cap 1 there is however formed an additional spout 34 which at its lower end comprises an outwardly projecting edge 35. As a result, if the lid cap is rotated then this spout 34 rotates with it. From below a nipple 36 is pushed over this spout 34, and this nipple has an inwardly projecting edge 37 at its upper end. The geometry and elasticity of these two projecting edges 35, 37 permit the nipple 36 to just be pushed over the spout 34. The function of this nipple 36 which on the rotary cap 1 is axially displaceable as well as rotatable is as follows: If the self-opener closure is welded onto a film or prepared composite packaging and for this purpose with the lower side of the projection 7 on the pour-out spout 2 is welded onto the film or packaging, then simultaneously the lower edge 40 of the nipple 36 is welded onto this film or packaging. On opening the closure for the first time then indeed as has already been explained the self-opener sleeve 3 is pushed downwards, the piercing and cutting member 9 pierces the film or composite packaging and afterwards the self-opener sleeve 3 is rotated so that the piercing and cutting member 9 executes a circular movement and at the same time cuts a circular disk shaped disk out of the film or the composite packaging. At the same time the piercing and cutting member 9 moves between the pour-out spout 2 and the nipple 36 about this nipple. Then simultaneously the rotary cap 1 is lifted by its thread and with it also the spout 34, whilst the nipple 36 remains stationary. The disk which is completely cut out of the film or the composite packaging after a 360° rotation of the self-opener sleeve 3 thereafter merely hangs at the lower edge of the nipple 36. If the rotary cap 1 is now removed then the spout 34 at its lower side pulls the nipple 36 upwards with it and the cut-out circular disk is then removed from the packaging by way of this.

FIG. 17 shows such a self-opener closure in a view from above and next to this and below this two sectional representations along the lines A-A and B-B in the figure. In these representations all parts are shown in the assembled condition. FIG. 18 shows the pour-out spout for the self-opener closure separately, from above as well as next to it and below in two diametrical sections along the lines A-A and B-B. FIG. 19 shows the self-opener sleeve 3 separately from above as well as next to it and below it in two diametrical sections along the lines A-A- and B-B in the figure. With this variant as in FIG. 19 one may see that the nipple 36 via two thin material webs 41 for which filled webs may indeed serve, are connected to the self-opener sleeve 3 so that these two parts may be injection moulded in one procedure. FIG. 20 finally shows the associated lid cap 1 separately, likewise from above as well as next to it and below it in two diametrical sections along the lines A-A and B-B in the figure. With this embodiment of the closure it is ensured that the cut-out film disk is completely removed and thus may no longer be pivoted down into the packaging.

Finally FIG. 21 again shows another variant of this self-opener closure, and specifically only an associated special lid cap 1. The particularity with this lid cap 1 is the fact that it comprises a metering spout 42 which is arranged concentrically to the cap 1 and which is integrally formed on the lower side of the cap lid 43. This spout 42 is formed by a tubular section which extends downwards from the lower side of the cap lid 43 and is dimensioned so long that when the lid cap 1 is screwed on, that is to say when this is screwed onto the pour-out spout with a self-opener sleeve lying in the inside, it projects downwards with its lower edge 44 beyond the flange-like projection 7 on the pour-out spout 2. If now the film or a composite laminate is welded onto the lower side of the projection 7 then the lower edge 44 of the metering spout 42 impinges this laminate or this film, as this is shown in FIG. 22. Here the lower region of the closure is shown in a diametrical section whilst one sees the lid cap 1 from the side. The closure with its pour-out spout 2 is welded onto the composite laminate 31 or a composite packaging or however onto a sealing film 30 which serves for sealingly closing a container or a bottle spout. Before the closure is however welded on, which is effected in the tipped position, so that thus the opening of the metering spout 42 projects upwards, the metering spout 42 is filled with a substance 45 which is to be metered later to the contents of the packaging, the container or the bottle. With such a substance it is the case of a solid substance, of one or more small pieces of this, of a powder-like or granular substance capable of being poured or of a flowable to liquid medium. On welding the film 30 or the composite laminate 31 onto the lower side of the pour-out spout 2, which is thus effected from above onto the tipped closure and pour-out spout 2, the metering spout 42 on account of its length abuts with its lower edge 44 on the film 30 or the laminate 31 and as a result this is welded slightly biased onto the lower side of the spout 2. By way of this a sealing of the contents 45 of the metering spout 42 is achieved by the film or the laminate 31. The contents are also well sealed against the surrounding air of the closure, on the one hand by the wall of the metering spout 42 and on the other hand further by the lid cap 1. The contents are thus insulated in a gas-tight and double-walled manner and any penetration of air or water vapour is prevented in a secure manner. On opening the closure for the first time the self-opener sleeve with its piercing cutters 9 cuts a disk out of the laminate 31 or the sealing film 30, by which means the contents 45 of the metering spout falls out of this into the composite packaging or bottle and is mixed with its contents.

The invention claimed is:

1. A self-opener closure for composite packagings or for container spouts to be closed with film material, comprising:

a pour-out spout capable of being sealingly assembled onto a composite packaging, a container spout or bottle spout closed with a film material;

rotary cap for said pour-out spout; and, a self-opener sleeve within said pour-out spout, said self-opener sleeve being rotatable via said rotary cap, and having at a lower edge and projecting from said lower edge of self-opener sleeve, least one combined piercing and cutting member, said self-opener sleeve, said pour-out spout and said rotary cap being equipped with guide and transmission means cooperating with one another, so that upon rotating said rotary cap for an initial time in a direction for opening, said self-opener sleeve is pushable axially downwards in said pour-out spout, the initial time, being without rotation, and for subsequent times, following the initial time, being rotatable about a rotary axis of said self-opener sleeve without axial movement.

2. The self-opener closure according to claim 1, wherein on a lower side of said rotary cap, and concentrically to said lower side, a spout is integrally formed with a projecting edge at a lower end of said spout, over which a nipple, with an inwardly projecting edge on its upper side, is pushable.

3. The self-opener closure according to claim 2, wherein said nipple is connected to said self-opener sleeve via thin-material webs for acting as break-off locations.

4. The self-opener closure according to claim 1, wherein said guide and transmission means on said rotary cap cooperating with one another includes two cylinder wall segments on an inner side of said rotary cap, and a lower edge of said two cylinder wall segments lying in an axial direction form a guide curve cooperating with said force transmission means on said self-opener sleeve, comprising two cams on an upper inner edge of said self-opener sleeve with the guide means cooperating with one another comprising guide ribs on an outer side of said self-opener sleeve and guide webs on an inner side of said pour-out spout, so that upon rotating said rotary cap in said direction for opening for the initial time, said self-opener sleeve is, initially, vertically pushable downwardly into said pour out spout and, subsequently, horizontally rotatable by approximately 360°.

5. The self-opener closure according to claim 1, wherein projecting from said lower edge of said self-opener sleeve are two combined piercing and cutting members approximately diametrically opposite one another, with said guide and force transmission means on said rotary cap cooperating with one another comprising three cylinder wall segments concentric relative to an axis of said rotary cap, with a lower edge of said three cylinder wall segments, lying in an axial direction, forming a guide curve cooperating with said guide and transmission means on said self-opener sleeve comprising three cams on an upper inner edge of said self-opener sleeve and said guide means cooperating with one another comprising guide ribs on an outer side of said self-opener sleeve and guide webs on an inner side of said pour-out spout, so that upon rotating said rotary cap said direction of opening for the initial time, said self-opener sleeve is initially pushable vertically and downwardly into said pour-out spout and, subsequently, rotatable over approximately 180° in the horizontal.

6. The self-opener closure according to claim 1, wherein said guide and transmission means on said rotary cap include a plurality of cylinder wall segments on an inner side of said rotary cap concentric to an axis of said rotary cap with a lower edge of said rotary cap lying therebelow, in an axial direction, forming two edge sections ascending counter to one another, and displaced to one another in said axial direction in a stepped manner, wherein a first edge section, as seen from below into said rotary cap ascends in a counterclockwise direction from a level of said rotary cap, and a second counter ascending edge section ascends in a clockwise direction from a level of the end of a first ascending edge section, and that said guide and transmission means on said self-opener sleeve includes a plurality of catching means on an upper edge thereof, with each said piercing and cutting member on said self-opener sleeve including a piercing cutter projecting from a lower sleeve edge with a sharpened tip and with cutting edges sharpened in a circumferential direction of said self-opener sleeve, along with said guide and transmission means on said self-opener sleeve cooperating with one another comprising a plurality of guide ribs distributed over its circumference on an outer wall, with in each case two vertical sections and a horizontal section connecting these on an upper side, and guide webs cooperating with said plurality of guide ribs on an inner wall of said pour-out spout, said plurality of guide webs having horizontal sections, wherein in an initial rotational position of said self-opener sleeve applied in said pour-out spout relative to said pour-out spout, extends over circumferential sections on said self-opener sleeve which remain free, wherein at least said two horizontal sections, as seen from above onto said pour-out spout in a clockwise direction, comprise a vertical section connecting thereto, so that upon unturning said rotary cap, said self-opener sleeve is vertically guided therein, so that a catching cam on said pour-out sleeve is pushable downwardly along said vertical sections of said plurality of guide ribs and said plurality of guide webs by said ascending edge section on a cylinder wall segment reaching upwards to said rotary cap, until said catching cam abuts on a step, and subsequently sets by said step into a horizontal rotation below, and along, said horizontal sections of said plurality of guide ribs and said plurality of guide webs.

7. The self-opener closure according to claim 6, wherein said rotary cap is a threaded cap having an inner thread with said pour-out spout being a threaded spout with an outer thread, and that one guide rib of said plurality of guide ribs is distributed on the outer wall of said self-opener sleeve over its circumference and extends over that circumferential region over which said piercing cutter extends, and that that said vertical section of said guide rib, as seen from above in the counterclockwise direction, is located in front of said piercing cutter, thus preceding it on rotation in the counterclockwise direction and extending upwardly to said lower edge of said self-opener sleeve, and at said lower inner edge of said pour-out spout there is formed an inwardly projecting abutment cam, wherein in an initial position of said self-opener sleeve applied in said pour-out spout, bears on location of said sharpened tip of said piercing cutter, wherein an effective height and pitch of a thread on said threaded cap is dimensioned so that said self-opener sleeve is, initially, pushable vertically downwardly by said guide and transmission means up to a screwed-free position of said threaded cap until said piercing cutter projects beyond said lower edge of said pour-out spout, and, subsequently, is rotatably over approximately 360° in a horizontal plane, in which position said vertical section of said guide rib reaching up to said edge abuts said abutment cam, thereby preventing a further rotation of said self-opener sleeve.

8. The self-opener closure according to claim 6, wherein said edge sections of said cylinder wall sections, as seen from below into said threaded cap, ascend clockwise and are dimensioned, so that, upon screwing said threaded cap onto said pour-out spout, after its unscrewing for the initial time, slide twice over said inwardly projecting cams on said self-opener sleeve, thereby resulting in a downwardly push within said pour-out spout.

9. The self-opener closure according to claim 1, wherein each said combined piercing and cutting member on said self-opener sleeve is a piercing cutter projecting from said lower edge of said self-opener sleeve formed as an isosceles triangle with a tip projecting downwardly lying between two equal length limbs of said isosceles triangle, with free triangle sides facing in a circumferential direction and forming a sharp edge.

10. The self-opener closure according to claim 1, wherein an inner side of said self-opener sleeve is coated with a soluble substance.

11. The self-opener closure according to claim 1, wherein said rotary cap includes a metering spout.

12. The self-opener closure according to claim 1, wherein on said lower edge of said rotary cap a guarantee strip is integrally formed with a plurality of fine material bridges pushable over a bead which is circumferential on said pour-out spout below its outer thread and encloses said pour-out spout on a lower side of said bead.

13. The self-opener closure according to claim 1, wherein an outer circumferential side of said rotary cap forms a knurled, or grooved grip, surface, and an upper side of said rotary cap includes at least one diametrical groove or a diametrically upwardly projecting web.

* * * * *